US010808299B2

(12) United States Patent
Kaneko

(10) Patent No.: US 10,808,299 B2
(45) Date of Patent: Oct. 20, 2020

(54) ALUMINUM ALLOY MATERIAL, AND CONDUCTIVE MEMBER, BATTERY MEMBER, FASTENING COMPONENT, SPRING COMPONENT, AND STRUCTURAL COMPONENT INCLUDING THE ALUMINUM ALLOY MATERIAL

(71) Applicant: FURUKAWA ELECTRIC CO., LTD., Tokyo (JP)

(72) Inventor: Hiroshi Kaneko, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 16/584,933

(22) Filed: Sep. 26, 2019

(65) Prior Publication Data

US 2020/0040432 A1 Feb. 6, 2020

Related U.S. Application Data

(63) Continuation of application No. PCT/JP2018/012826, filed on Mar. 28, 2018.

(30) Foreign Application Priority Data

Mar. 29, 2017 (JP) ..... 2017-065839
Mar. 29, 2017 (JP) ..... 2017-065840

(51) Int. Cl.
*C22F 1/05* (2006.01)
*H01B 1/02* (2006.01)
(Continued)

(52) U.S. Cl.
CPC ..... *C22C 21/06* (2013.01); *C22C 21/08* (2013.01); *C22F 1/05* (2013.01); *H01B 1/023* (2013.01)

(58) Field of Classification Search
CPC ..... C22C 21/08; C22F 1/05; H01B 1/023
See application file for complete search history.

(56) References Cited

U.S. PATENT DOCUMENTS 5,826,456 A 10/1998 Kawazoe et al.
2004/0079457 A1 4/2004 Kimura et al.
(Continued)

FOREIGN PATENT DOCUMENTS

JP H05331585 A 12/1993
JP H09137244 A 5/1997
(Continued)

OTHER PUBLICATIONS

English Translation of Decision to Grant a Patent received in JP Application No. 2018-538794 dated Oct. 1, 2018.
(Continued)

*Primary Examiner* — George Wyszomierski
(74) *Attorney, Agent, or Firm* — Dorsey & Whitney LLP

(57) ABSTRACT

The aluminum alloy material of the present disclosure has a specific alloy composition and has a fibriform metallographic structure where crystal grains extend so as to be aligned in one direction, wherein an average value of a size perpendicular to a longitudinal direction of the crystal grains is 400 nm or less in a cross section parallel to the one direction. The aluminum alloy material of the present disclosure has a main surface having a crystal orientation distribution which satisfies a peak intensity ratio R ($I_{200}/I_{220}$) of a peak intensity $I_{200}$ of a diffraction peak due to a {100} plane to a peak intensity $I_{220}$ of a diffraction peak due to a {110} plane, of 0.20 or more, determined by an X-ray diffraction method.

14 Claims, 10 Drawing Sheets

(51) Int. Cl.
*C22C 21/08* (2006.01)
*C22C 21/06* (2006.01)

(56) References Cited

U.S. PATENT DOCUMENTS

| | | | | |
|---|---|---|---|---|
| 2011/0272175 | A1* | 11/2011 | Sekiya | C22C 21/14 174/128.1 |
| 2015/0007910 | A1* | 1/2015 | Sekiya | C22C 21/00 148/502 |
| 2019/0136351 | A1 | 5/2019 | Kaneko et al. | |

FOREIGN PATENT DOCUMENTS

| | | | |
|---|---|---|---|
| JP | 2000026946 | A | 1/2000 |
| JP | 2001131721 | A | 5/2001 |
| JP | 2003027172 | A | 1/2003 |
| JP | 2003321755 | A | 11/2003 |
| JP | 2010159445 | A | 7/2010 |
| JP | 2012087411 | A | 5/2012 |
| JP | 2017048452 | A | 3/2017 |
| WO | 2018012482 | A1 | 1/2018 |

OTHER PUBLICATIONS

International Search Report and Written Opinion received in PCT/JP2018/012826 dated Jun. 19, 2018 (Engl. Translation of ISR only).
English translation of Written Opinion for Application No. PCT/JP2018/012826, dated Jun. 19, 2018.
International Preliminary Report on Patentability for Application No. PCT/JP2018/012826, dated Oct. 1, 2019.

* cited by examiner

FIG. 2. Wire textures of various f.c.c. metals and alloys as a function of the parameter $\gamma/Gb$. Stacking-fault energy increases towards the right side of the figure. Both high and low SFE lead to sharp ⟨111⟩ textures.

ALUMINUM ALLOY MATERIAL, AND CONDUCTIVE MEMBER, BATTERY MEMBER, FASTENING COMPONENT, SPRING COMPONENT, AND STRUCTURAL COMPONENT INCLUDING THE ALUMINUM ALLOY MATERIAL

CROSS REFERENCE TO RELATED APPLICATIONS

This is a continuation application of International Patent Application No. PCT/JP2018/012826 filed Mar. 28, 2018, which claims the benefit of Japanese Patent Application Nos. 2017-065839 and 2017-065840 filed Mar. 29, 2017, respectively, and the full contents of all of which are hereby incorporated by reference in their entirety.

BACKGROUND

Technical Field

The present disclosure relates to an aluminum alloy material having high strength. Such an aluminum alloy material is used for a wide range of applications, for example, a conductive member (an elevator cable, an airplane electric wire, and the like), a battery member, a fastening component, a spring component, and a structural component.

Description of the Related Art

According to the diversification of the shapes of metal members, a technique has been recently widely studied which involves molding a three-dimensional structure having a desired shape by sintering a metal powder with electron beams, lasers, or the like. Such a technique, however, uses the metal powder and has, for example, a problem of easily causing an explosion due to an excessively fine metal powder.

Thus, for example, a technique has been recently developed which involves molding into a three-dimensional structure according to a method for knitting, weaving, tying, jointing, or connecting metal fine wires. Such a method has been progressively studied for Wire-Woven Cellular Materials, for example, and has been expected to be applied to a battery component, a heat sink, an impact absorption member, and the like.

While an iron-based or copper-based wire rod has been widely used for the metal fine wires, there has been recently considered substitution for an aluminum-based material which has not only a small specific gravity and a large thermal expansion coefficient as compared with an iron-based or copper-based metal material, but also comparatively good electrical and heat conductivities and excellent corrosion resistance, particularly has a small elastic coefficient and is flexibly elastically deformed.

A pure aluminum material, however, has a problem of having a lower strength than that of such an iron-based or copper-based metal material. In addition, 2000-series (Al—Cu-based) and 7000-series (Al—Zn—Mg-based) aluminum alloy materials which are aluminum alloy materials having a comparatively high strength have a problem of having poor corrosion resistance and stress corrosion cracking resistance.

Thus, there has been recently widely used a 6000-series (Al—Mg—Si-based) aluminum alloy material which contains Mg and Si and has excellent electrical and heat conductivities, and excellent corrosion resistance. Such a 6000-series aluminum alloy material, however, does not have a sufficient strength, despite having a higher strength among aluminum alloy materials, and thus there is a desire for further improvement in strength.

On the other hand, there are known methods for improving strength of an aluminum alloy material, for example, a method according to crystallization of an aluminum alloy material provided with an amorphous phase (Japanese Patent Application Publication No. H05-331585), a method for forming fine crystal grains according to the ECAP method (Japanese Patent Application Publication No. H09-137244), a method for forming fine crystal grains according to cold working at a temperature equal to or less than room temperature (Japanese Patent Application Publication No. 2001-131721), and a method for dispersing carbon nanofibers (Japanese Patent Application Publication No. 2010-159445). Such methods, however, cause an aluminum alloy material having a small size to be manufactured, and are difficult to industrially put to practical use.

Japanese Patent Application Publication No. 2003-027172 discloses a method for obtaining an Al—Mg-based alloy having a fine structure by control of a rolling temperature. The method has excellent industrial mass productivity, but is required to be further improved in strength.

On the other hand, such an aluminum alloy material also generally has the problem of being deteriorated in bending workability which conflicts with strength, due to an improvement in strength. Thus, such an aluminum alloy material is also desired to be not only improved in strength, but also further enhanced in bending workability, when used as a fine wire for molding into a three-dimensional structure.

SUMMARY

The present disclosure is related to providing an aluminum alloy material which can serve as a substitute for an iron-based or copper-based metal material and which has a high strength and excellent bending workability, and a conductive member, a battery member, a fastening component, a spring component and a structural component including the aluminum alloy material.

According to an aspect of the present disclosure, an aluminum alloy material has an alloy composition containing 0.2 to 1.8% by mass of Mg, 0.2 to 2.0% by mass of Si, 0.01 to 1.50% by mass of Fe, 0 to 2.0% by mass in total of at least one selected from Cu, Ag, Zn, Ni, B, Ti, Co, Au, Mn, Cr, V, Zr and Sn, with the balance containing Al and inevitable impurities. The aluminum alloy material has a fibriform metallographic structure where crystal grains extend so as to be aligned in one direction. An average value of a size perpendicular to a longitudinal direction of the crystal grains is 400 nm or less in a cross section parallel to the one direction. The aluminum alloy material has a main surface having a crystal orientation distribution which satisfies a peak intensity ratio R ($I_{200}/I_{220}$) of a peak intensity $I_{200}$ of a diffraction peak due to a {100} plane to a peak intensity $I_{220}$ of a diffraction peak due to a {110} plane, of 0.20 or more, determined by an X-ray diffraction method.

Further, it is preferable that the aluminum alloy material contains 0% by mass in total of at least one selected from Cu, Ag, Zn, Ni, B, Ti, Co, Au, Mn, Cr, V, Zr and Sn.

Further, it is preferable that the aluminum alloy material contains 0.06 to 2.0% by mass in total of at least one selected from Cu, Ag, Zn, Ni, B, Ti, Co, Au, Mn, Cr, V, Zr and Sn.

Further, it is preferable that the aluminum alloy material has a Vickers hardness (HV) of 100 to 250.

Further, it is preferable that the aluminum alloy material is covered with at least one metal selected from the group consisting of Cu, Ni, Ag, Sn, Au and Pd.

According to another aspect of the present disclosure, a conductive member includes the aluminum alloy material.

Further, it is preferable that the conductive member is an elevator cable.

Further, it is preferable that the conductive member is an airplane electric wire.

According to another aspect of the present disclosure, a battery member includes the aluminum alloy material.

According to another aspect of the present disclosure, a fastening component includes the aluminum alloy material.

According to another aspect of the present disclosure, a spring component includes the aluminum alloy material.

According to another aspect of the present disclosure, a structural component includes the aluminum alloy material.

The present disclosure provides an aluminum alloy material simultaneously satisfying a high strength comparable to those of an iron-based or copper-based metal material and excellent bending workability by an aluminum alloy material having not only a predetermined alloy composition, but also a fibriform metallographic structure where crystal grains extend so as to be aligned in one direction, wherein an average value of a size perpendicular to a longitudinal direction of the crystal grains is 400 nm or less in a cross section parallel to the one direction, and the aluminum alloy material has a main surface having a crystal orientation distribution which satisfies a peak intensity ratio R ($I_{200}/I_{220}$) of a peak intensity $I_{200}$ of a diffraction peak due to a {100} plane to a peak intensity $I_{220}$ of a diffraction peak due to a {110} plane, of 0.20 or more, determined by an X-ray diffraction method, and a conductive member, a battery member, a fastening component, a spring component and a structural component including the aluminum alloy material.

BRIEF DESCRIPTION OF DRAWINGS

FIG. 4B illustrates the normal direction ND (surface direction) and the longitudinal direction LD (wire drawing direction DD) of the wire rod.

FIG. 7A is a transverse cross-sectional view and FIG. 7B is a plan view.

FIG. 8A illustrates an aspect formed from an aggregated twisted wire, FIG. 8B illustrates an aspect formed from a concentric twisted wire having a 1×37 structure, and FIG. 8C illustrates an aspect formed from a rope twisted wire having a 7×7 structure.

DETAILED DESCRIPTION

Figure 1:
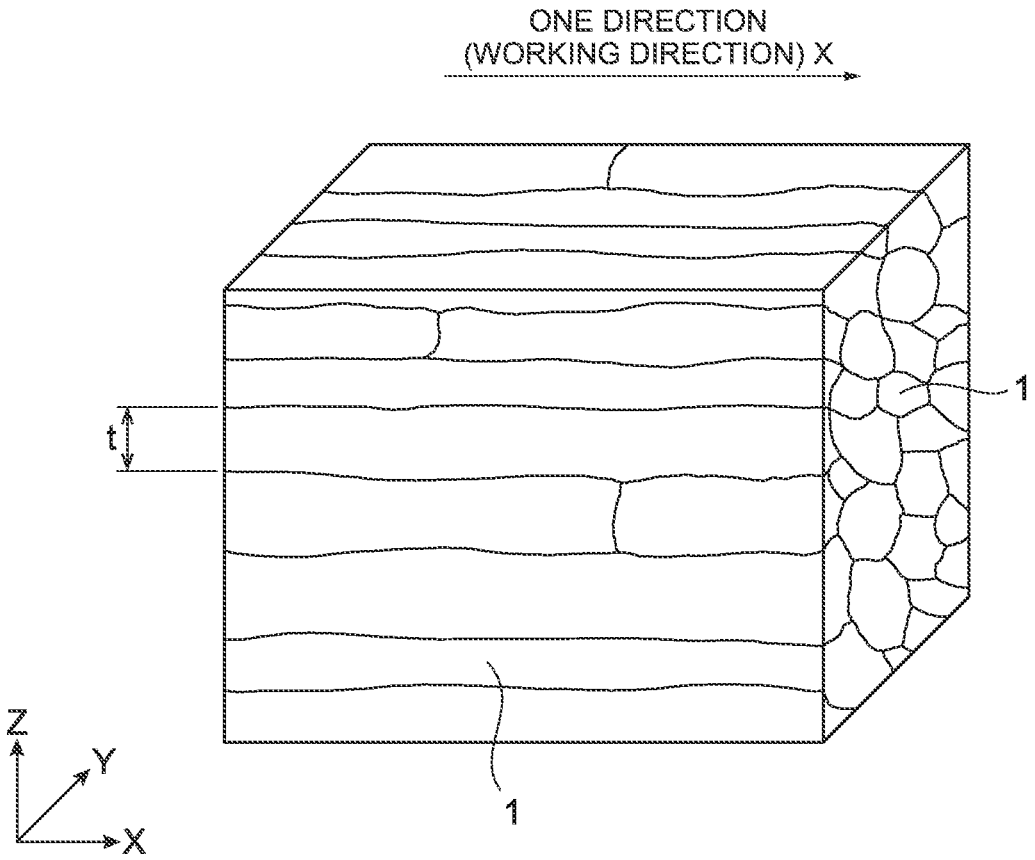
FIG. 1 is a perspective view schematically illustrating the situation of the metallographic structure of the aluminum alloy material according to the present disclosure.

Hereinafter, preferred embodiments of the aluminum alloy material of the present disclosure are described in detail. Hereinafter, the numerical value range expressed by use of "to" means that the numerical values described before and after "to" are encompassed as the lower limit and the upper limit, respectively.

An aluminum alloy material according to the present disclosure not only has an alloy composition containing 0.2 to 1.8% by mass of Mg, 0.2 to 2.0% by mass of Si, 0.01 to 1.50% by mass of Fe, 0 to 2.0% by mass in total of at least one selected from Cu, Ag, Zn, Ni, B, Ti, Co, Au, Mn, Cr, V, Zr and Sn, with the balance containing Al and inevitable impurities, but also has a fibriform metallographic structure where crystal grains extend so as to be aligned in one direction, wherein the average value of a size perpendicular to the longitudinal direction of the crystal grains is 400 nm or less in a cross section parallel to the one direction and furthermore the aluminum alloy material has a main surface having a crystal orientation distribution which satisfies a peak intensity ratio R ($I_{200}/I_{220}$) of a peak intensity $I_{200}$ of a diffraction peak due to a {100} plane to a peak intensity $I_{220}$ of a diffraction peak due to a {110} plane, of 0.20 or more, determined by an X-ray diffraction method.

A component where the lower limit of the content range is described to be "0% by mass", among components whose content ranges in the alloy composition are listed, means any component appropriately suppressed or any component to be, if necessary, optionally added. Specifically, "0% by mass" means that such any component is not included.

Herein, the "crystal grains" refer to portions surrounded by orientation difference boundaries. Here, the "orientation difference boundary" refers to a boundary where contrast (channeling contrast) discontinuously changes in a case in which a metallographic structure is observed by scanning electron microscopy (TEM), scanning transmission electron microscopy (STEM), scanning ion microscopy (SIM), or the like. The size perpendicular to the longitudinal direction of the crystal grains corresponds to the interval of the orientation difference boundaries.

The "main surface" refers to a surface which is parallel to the working direction (stretching direction) of the aluminum alloy material and which is subjected to stretching working (thickness reduction working) by direct contact with a tool (a rolling mill roll or a drawing die) (hereinafter, referred to as "worked surface"). For example, in a case where the aluminum alloy material is a wire bar, the main surface (worked surface) of the aluminum alloy material is a surface parallel to the wire drawing direction (longitudinal direction) of the wire bar, and in a case where the aluminum alloy material is a plate, the main surface (worked surface) of the aluminum alloy material is each of surfaces (two surfaces as front and rear surfaces) among any surfaces parallel to the rolling direction of the plate.

The working direction refers to a direction of progression of stretching working. For example, in a case where the aluminum alloy material is a wire bar, the longitudinal direction (perpendicular to the wire diameter) of the wire bar corresponds to a wire drawing direction. In a case where the aluminum alloy material is a plate, the longitudinal direction of the plate being subjected to rolling working corresponds to a rolling direction. Such a plate may be here subjected to rolling working and then cut to a predetermined size to provide a small piece. In such a case, the rolling direction can be confirmed from a worked surface in the plate surface, although the longitudinal direction after the cutting is not necessarily matched with the working direction in such a case.

The aluminum alloy material according to the present disclosure has a fibriform metallographic structure where crystal grains extend so as to be aligned in one direction. FIG. 1 illustrates a perspective view schematically illustrating the situation of the metallographic structure of the aluminum alloy material according to the present disclosure. As illustrated in FIG. 1, the aluminum alloy material of the present disclosure has a fibriform structure where crystal grains 1 each having an elongated shape extend so as to be aligned in one direction X. Such crystal grains each having an elongated shape are different from conventional fine crystal grains and flat crystal grains each having merely a large aspect ratio. Specifically, the crystal grains in the present disclosure each have an elongated shape as in fibers, and the average value of a size t perpendicular to the longitudinal direction (working direction X) thereof is 400 nm or less. The fibriform metallographic structure where the fine crystal grains extend so as to be aligned in one direction can be said to be a novel metallographic structure which is not included in any conventional aluminum alloy material.

Furthermore, the aluminum alloy material of the present disclosure has a main surface controlled to have a crystal orientation distribution which satisfies a peak intensity ratio R ($I_{200}/I_{220}$) of the peak intensity $I_{200}$ of the diffraction peak due to the {100} plane to the peak intensity $I_{220}$ of the diffraction peak due to the {110} plane, of 0.20 or more, determined by an X-ray diffraction method. Any texture controlled to have such a predetermined crystal orientation distribution can be said to be a novel texture which is not included in a main surface of any conventional aluminum alloy material.

The aluminum alloy material of the present disclosure, which has not only the metallographic structure, but also the texture on the main surface, can simultaneously attain a high strength (for example, a tensile strength of 370 MPa and a Vickers hardness (HV) of 100 or more) comparable to that of an iron-based or copper-based metal material and excellent bending workability (for example, the aluminum alloy material, which is a wire rod, does not cause any cracking, when having an inner bending radius corresponding to 30 to 70% of the wire diameter in the W bending test performed according to JIS Z 2248: 2006).

A finer crystal grain size directly leads to not only an improvement in strength, but also the effect of improving grain boundary corrosion, the effect of improving fatigue characteristics, the effect of reducing the roughness of a surface after plastic working, and the effect of reducing sagging and burr during shearing working, and thus exerts the effect of generally improving any functions of the material.

The aluminum alloy material of the present disclosure can attain a high strength even if having an Al—Mg—Si—Fe-based alloy composition having a small number of constituent elements, and can also be highly improved in recyclability due to a small number of kinds of constituent elements.

(1) Alloy Composition

First Embodiment

An alloy composition in an aluminum alloy material of a first embodiment of the present disclosure, and the effects thereof are described.

The aluminum alloy material of the first embodiment of the present disclosure contains 0.2 to 1.8% by mass of Mg, 0.2 to 2.0% by mass of Si, 0.01 to 1.50% by mass of Fe, and 0% by mass in total of at least one selected from Cu, Ag, Zn, Ni, B, Ti, Co, Au, Mn, Cr, V, Zr and Sn. Specifically, the aluminum alloy material of the first embodiment has an alloy composition contains Mg, Si and Fe as essential additive elements, with the balance containing Al and inevitable impurities.

<0.2 to 1.8% by Mass of Mg>

Mg (magnesium) has not only the effect of strengthening by forming a solid solution in an aluminum matrix, but also the effect of improving tensile strength by a synergistic effect with Si. In a case where the Mg content, however, is less than 0.2% by mass, the function effects are insufficient, and in a case where the Mg content is more than 1.8% by mass, a crystallized material is formed, causing deterioration in workability (wire drawing workability, bending workability, and the like). Therefore, the Mg content is 0.2 to 1.8% by mass, preferably 0.4 to 1.4% by mass.

<0.2 to 2.0% by Mass of Si>

Si (silicon) has not only the effect of strengthening by forming a solid solution in an aluminum matrix, but also the effect of improving tensile strength and bending fatigue resistance by a synergistic effect with Mg. In a case where the Si content, however, is less than 0.2% by mass, the function effects are insufficient, and in a case where the Si content is more than 2.0% by mass, a crystallized material is formed, causing deterioration in workability. Therefore, the Si content is 0.2 to 2.0% by mass, preferably 0.4 to 1.4% by mass.

<0.01 to 1.50% by Mass of Fe>

Fe (iron) is an element which forms an Al—Fe based intermetallic compound to thereby not only contribute to refinement of crystal grains, but also provide an improved tensile strength. The intermetallic compound refers to a compound formed from two or more kinds of metals. Fe can be formed into a solid solution with Al only at a content of 0.05% by mass at 655° C. and at a lower content at room temperature. Accordingly, the remaining Fe which cannot be formed into such a solid solution with Al is crystallized or precipitated as an intermetallic compound such as Al—Fe, Al—Fe—Si, or Al—Fe—Si—Mg. Such an intermetallic compound mainly formed from Fe and Al is herein referred to as "Fe-based compound". The intermetallic compound contributes to refinement of crystal grains and also provides an improved tensile strength. Fe has the effect of providing an improved tensile strength also due to Fe in the form of such a solid solution with Al. In a case where the Fe content is less than 0.01% by mass, such function effects are insufficient, and in a case where the Fe content is more than 1.50% by mass, a crystallized material increases, causing deterioration in workability. The crystallized material refers to an intermetallic compound to be generated during the casting solidification of an alloy. Therefore, the Fe content is 0.01 to 1.50% by mass, preferably 0.05 to 0.33% by mass, more preferably 0.05 to 0.29% by mass, still more preferably 0.05 to 0.16% by mass.

<Balance: Al and Inevitable Impurities>

The balance, i.e., components other than those described above, includes Al (aluminum) and inevitable impurities. The inevitable impurities mean impurities contained at levels so that such impurities may be contained inevitably during a manufacturing process. Since the inevitable impurities may cause a decrease in conductivity depending on the content thereof, it is preferable to suppress the content of the inevitable impurities to some extent in consideration of such a decrease in conductivity. Examples of components as the inevitable impurities include Bi (bismuth), Pb (lead), Ga (gallium), and Sr (strontium). The upper limit of the content of each of the components may be 0.05% by mass, and the upper limit of the total amount of the components may be 0.15% by mass.

Second Embodiment

Next, an alloy composition in an aluminum alloy material of a second embodiment of the present disclosure, and the effects thereof are described.

The aluminum alloy material of the second embodiment of the present disclosure contains 0.2 to 1.8% by mass of Mg, 0.2 to 2.0% by mass of Si, 0.01 to 1.50% by mass of Fe, and 0.06 to 2.0% by mass in total of at least one selected from Cu, Ag, Zn, Ni, B, Ti, Co, Au, Mn, Cr, V, Zr and Sn. Specifically, the aluminum alloy material of the second embodiment has an alloy composition containing Mg, Si and Fe as essential additive elements, at least one selected from Cu, Ag, Zn, Ni, B, Ti, Co, Au, Mn, Cr, V, Zr and Sn, as a further optional additive element, with the balance containing Al and inevitable impurities.

<0.2 to 1.8% by Mass of Mg>

Mg (magnesium) has not only the effect of strengthening by forming a solid solution in an aluminum matrix, but also the effect of improving tensile strength by a synergistic effect with Si. In a case where the Mg content, however, is less than 0.2% by mass, the function effects are insufficient, and in a case where the Mg content is more than 1.8% by mass, a crystallized material is formed, causing deterioration in workability (wire drawing workability, bending workability, and the like). Therefore, the Mg content is 0.2 to 1.8% by mass, preferably 0.4 to 1.4% by mass.

<0.2 to 2.0% by Mass of Si>

Si (silicon) has not only the effect of strengthening by forming a solid solution in an aluminum matrix, but also the effect of improving tensile strength and bending fatigue resistance by a synergistic effect with Mg. In a case where the Si content, however, is less than 0.2% by mass, the function effects are insufficient, and in a case where the Si content is more than 2.0% by mass, a crystallized material is formed, causing deterioration in workability. Therefore, the Si content is 0.2 to 2.0% by mass, preferably 0.4 to 1.4% by mass.

<0.01 to 1.50% by Mass of Fe>

Fe (iron) is an element which forms an Al—Fe based intermetallic compound to thereby not only contribute to refinement of crystal grains, but also provide an improved tensile strength. The intermetallic compound refers to a compound formed from two or more kinds of metals. Fe can be formed into a solid solution with Al only at a content of 0.05% by mass at 655° C. and at a lower content at room temperature. Accordingly, the remaining Fe which cannot be formed into such a solid solution with Al is crystallized or precipitated as an intermetallic compound such as Al—Fe, Al—Fe—Si, or Al—Fe—Si—Mg. Such an intermetallic compound mainly formed from Fe and Al is herein referred to as "Fe-based compound". The intermetallic compound contributes to refinement of crystal grains and also provides an improved tensile strength. Fe has the effect of providing an improved tensile strength also due to Fe in the form of such a solid solution with Al. In a case where the Fe content is less than 0.01% by mass, such function effects are insufficient, and in a case where the Fe content is more than 1.50% by mass, a crystallized material increases, causing deterioration in workability. The crystallized material refers to an intermetallic compound to be generated during the casting solidification of an alloy. Therefore, the Fe content is 0.01 to 1.50% by mass, preferably 0.05 to 0.33% by mass, more preferably 0.05 to 0.29% by mass, still more preferably 0.05 to 0.16% by mass.

The aluminum alloy material of the second embodiment of the present disclosure contains, in addition to Mg, Si and Fe as essential additive elements, 0.06 to 2.0% by mass in total of at least one selected from Cu, Ag, Zn, Ni, B, Ti, Co, Au, Mn, Cr, V, Zr and Sn.

<At Least One Selected from Cu, Ag, Zn, Ni, B, Ti, Co, Au, Mn, Cr, V, Zr and Sn: 0.06 to 2.0% by Mass in Total>

Cu (copper), Ag (silver), Zn (zinc), Ni (nickel), B (boron), Ti (titanium), Co (cobalt), Au (gold), Mn (manganese), Cr (chromium), V (vanadium), Zr (zirconium), and Sn (tin) are each an element which provides improved heat resistance. Examples of a mechanism in which such components provide improved heat resistance include a mechanism in which the energy of a crystal grain boundary is reduced due to a large difference between the atomic radius of each of the component and the atomic radius of aluminum, a mechanism in which the mobility of a grain boundary is reduced due to large diffusion coefficients of the components in a case of entering of the components into the grain boundary, and a mechanism in which a diffusion phenomenon is delayed due to large interaction with holes and trapping of the holes, and these mechanisms are considered to act synergistically.

In a case where the total of the contents of the components is less than 0.06% by mass, the function effects are insufficient, and in a case where the total of the contents of the components is more than 2.0% by mass, workability is deteriorated. Therefore, the total of the content(s) of at least one selected from Cu, Ag, Zn, Ni, B, Ti, Co, Au, Mn, Cr, V, Zr and Sn is 0.06 to 2.0% by mass, preferably 0.3 to 1.2% by mass. Such component(s) may be included singly or in combination of two or more kinds thereof. In particular, it is preferable to contain at least one selected from Zn, Ni, B, Ti, Co, Mn, Cr, V, Zr and Sn, in consideration of corrosion resistance in use under a corrosion environment.

<Balance: Al and Inevitable Impurities>

The balance, i.e., components other than those described above, includes Al (aluminum) and inevitable impurities. The inevitable impurities mean impurities contained at levels so that such impurities may be contained inevitably during a manufacturing process. Since the inevitable impurities may cause a decrease in conductivity depending on the content thereof, it is preferable to suppress the content of the inevitable impurities to some extent in consideration of such a decrease in conductivity. Examples of components as inevitable impurities include Bi (bismuth), Pb (lead), Ga (gallium), and Sr (strontium). The upper limit of the content of each of the components may be 0.05% by mass, and the upper limit of the total amount of the components may be 0.15% by mass.

Such an aluminum alloy material can be achieved by combining and controlling the alloy composition and a manufacturing process. Hereinafter, a suitable manufacturing method of the aluminum alloy material of the present disclosure is described.

(2) Manufacturing Method of Aluminum Alloy Material of One Example of Present Disclosure Such an aluminum alloy material of one example of the present disclosure is improved in strength particularly by introducing a crystal grain boundary into an Al—Mg—Si—Fe-based alloy at a high density. Therefore, an approach to an improvement in strength is largely different from that in a method of precipitation-hardening a Mg—Si compound, which has been generally performed with respect to a conventional aluminum alloy material. Furthermore, such an aluminum alloy material of one example of the present disclosure is not merely improved in strength, but improved in strength and kept and enhanced in bending workability at the same time resulting from the following: a stabilizing heat treatment is incorporated into stretching working in a predetermined condition to thereby promote and stabilize rearrangement of lattice defects in an Al—Mg—Si—Fe-based alloy, resulting in the relaxation of internal stress and the change in crystal orientation distribution to be formed by deformation.

In a preferable manufacturing method of the aluminum alloy material of the present disclosure, the aluminum alloy material having a predetermined alloy composition is not subjected to an aging precipitation heat treatment [0], but subjected to a set of treatments, including cold working [1] at a degree of working of 1.2 or less and stabilizing heat treatment [2] at a treatment temperature of 50 to 80° C. for a retention time of 2 to 10 hours, defined as one set, repeatedly for three or more sets in the listed order, thereby making the total degree of working in cold working [1] 3.0 or more. Refine annealing [3] may be performed as a final step if needed. Hereinafter, the manufacturing method is described in detail.

Application of deformation stress to a metal material usually allows crystal slip to occur as the elementary step of the deformation of a metal crystal. Any metal material where such crystal slip more easily occurs can be said to be smaller in stress required for deformation and to have a lower strength. Therefore, it is important for an improvement in strength of the metal material to suppress any crystal slip occurring in the metallographic structure. Examples of the prevention factor of such crystal slip include the existence of the crystal grain boundary in the metallographic structure. Such a crystal grain boundary can prevent the crystal slip from spreading in the metallographic structure in application of deformation stress to the metal material, resulting in an improvement in strength of the metal material.

Therefore, it is considered to be desirable for an improvement in strength of the metal material to introduce the crystal grain boundary into the metallographic structure at a high density. The formation mechanism of the crystal grain boundary is considered to be the division of the metal crystal involving the following deformation of the metallographic structure, for example.

An internal stress state of a polycrystalline material is usually a complicated multiaxial state due to the difference between the orientations of adjacent crystal grains, and the space distribution of distortion between the vicinity of a surface layer in contact with a working tool and the inside of the bulk. A crystal grain which is in a single orientation before deformation is divided to be in a plurality of orientations with the deformation under these influences, and a crystal grain boundary is formed between crystals divided.

The crystal grain boundary formed, however, has surface energy in a structure deviated from the closest packed atomic arrangement of usual twelve coordination. Therefore, it is considered that the crystal grain boundary, in the case of having a given density or more, allows the internal energy increased to serve as a driving force in a usual metallographic structure to result in the occurrence of dynamic or static recovery and recrystallization. Therefore, it is usually considered that, even if the amount of deformation is increased, the increase and reduction of the crystal grain boundary simultaneously occur to allow a grain boundary density to be saturated.

Figure 2:
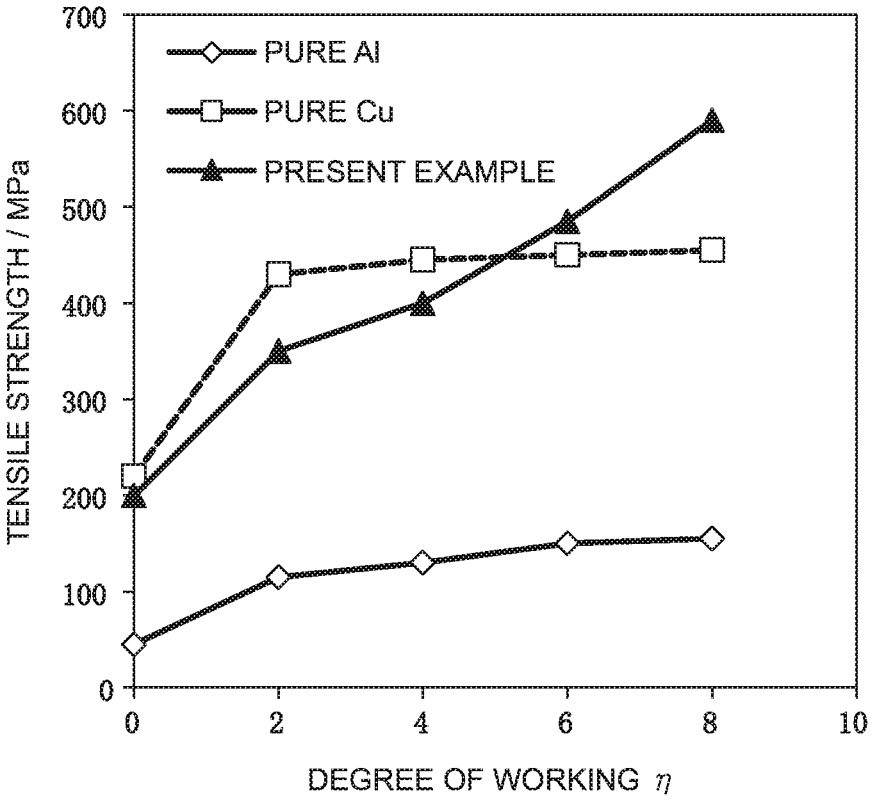
FIG. 2 is a graph representing the respective relationships between the degrees of working and the tensile strengths of pure aluminum, pure copper, and the aluminum alloy material according to the present disclosure.

Such a phenomenon also coincides with the relationship between the degree of working and the tensile strength in pure aluminum and pure copper each having a conventional metallographic structure. FIG. 2 illustrates a graph representing the respective relationships between the degrees of working and the tensile strengths of pure aluminum, pure copper, and the aluminum alloy material according to the present disclosure. In the case of the aluminum alloy material according to the present disclosure, the degree of working in the horizontal axis of FIG. 2 means the total degree of working of cold working [1] for three or more times.

As illustrated in FIG. 2, while pure aluminum and pure copper each having a usual metallographic structure is observed to have an improved tensile strength (hardening) at a comparatively low degree of working, the amount of hardening tends to be saturated as the degree of working increases. It is considered that the degree of working corresponds to the amount of deformation applied to the metallographic structure and the saturation of the amount of hardening corresponds to the saturation of the grain boundary density.

On the contrary, it has been found that the aluminum alloy material of the present disclosure, even if being increased in the degree of working, is continuously hardened and the strength thereof continuously increases with working. The reason for this is considered because the aluminum alloy material of the present disclosure has the above alloy composition, in particular, includes predetermined amounts of Mg and Si compositely added thereto, thereby enabling the increase in internal energy to be suppressed even if the crystal grain boundary has a given density or more in the metallographic structure. It is considered that recovery and recrystallization in the metallographic structure can be thus prevented to thereby allow the crystal grain boundary in the metallographic structure to be effectively increased.

Although the mechanism of an improvement in strength due to such composite addition of Mg and Si is not necessarily clear, the mechanism is considered to be based on the following: (i) a Mg atom having a larger atomic radius and a Si atom having a smaller atomic radius than that of an Al atom are used in combination to thereby allow the respective atoms in the aluminum alloy material to be always densely packed (alignment), and (ii) divalent Mg and tetravalent Si coexist with a trivalent Al atom, thereby enabling a trivalent state to be formed in the entire aluminum alloy material to result in valence stability, thereby enabling an increase in internal energy with working to be effectively suppressed.

In general, a metal material subjected to stretching working is low in elongation which corresponds to about several percent relative to tension, and is poor in ductility. Therefore, in a case where an improvement in strength is tried to be made by the above method, bending workability as property conflicting with strength tends to be deteriorated. In particular, aluminum and an aluminum alloy are poorer in bending workability than copper and nickel, even in comparison of materials having the same degree of elongation.

Cracks which occur due to bending deformation are generated by causing a metal crystal to be non-uniformly deformed to result in the occurrence of local distortion, formation of irregularities on the surface of the metal material, and progression of further localization of deformation with such irregularities serving as points of stress concentration. Such non-uniform deformation is a plastic instability phenomenon after the metal material meets the limitation on hardening with working.

The present inventor has found that ease of the occurrence of such non-uniform deformation is associated with the crystal orientation of a metal material. In a case where stress of uniaxial deformation due to drawing working, swaging working or the like, or planar distortion deformation due to rolling working or the like is applied to a metal material of a FCC (face-centered cubic lattice) metal, a stable orientation due to such deformations is usually a crystalline orientation where the {100} plane or the {111} plane of a crystal is oriented in the longitudinal direction LD: Longitudinal Direction (stretching direction DD: Drawing Direction) of the metal material (LD is parallel to the <100> direction or the <111> direction, hereinafter, designated as LD//<100> or LD//<111>). In particular, the crystalline orientation in LD//<100> is hardly non-uniformly deformed. On the contrary, a crystal oriented in LD//<111> is easily non-uniformly deformed even if any crystal plane is directed to the surface direction (normal direction ND: Normal Direction). Specifically, what is of significance for ease of the occurrence of non-uniform deformation is which crystal plane is directed to LD.

Figure 3:
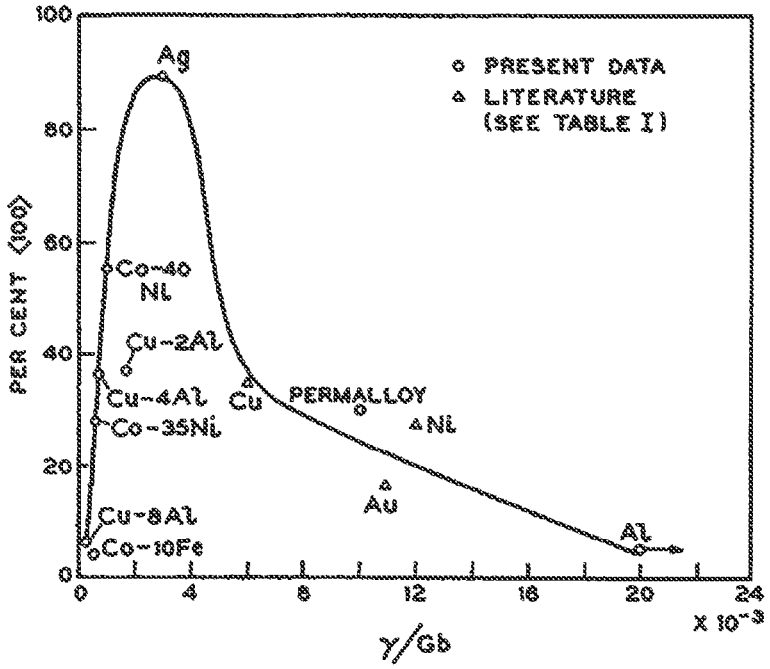
FIG. 3 is a diagram where the crystal orientation distributions of various face-centered cubic metals after cold wire drawing are organized by stacking fault energy (quoted from A. T. ENGLISH and G. Y. CHIN, "On the variation of wire texture with stacking fault energy in f.c.c. metals and alloys" ACTA METALLURGICA VOL. 13 (1965) p. 1013-1016).

It, however, is known that the crystal orientation distribution which is generated by the working deformation, in particular, the proportion of a crystal oriented in LD//<100> or LD//<111> varies depending on the type of metal. For example, it has been reported according to the studies by A. T. English et al, in 1965, that the crystal orientation distribution of aluminum subjected to wire drawing working at a reduction of area of 99.97% is largely different from those of copper and nickel which are similarly FCC metals. As illustrated in FIG. 3, the rates of crystalline orientations (volume ratio of each crystal) in LD//<100> of copper and nickel are 34% and 27%, respectively. On the contrary, the rate of the crystalline orientation (volume ratio of a crystal) in LD//<100> of aluminum is only 5%, specifically, a crystal orientation distribution with the crystalline orientation in LD//<111> being remarkable is made. Accordingly, in the case of an aluminum alloy material produced according to a usual working method (drawing working, rolling working, or the like), most of a crystalline orientation occurring due to deformation is the crystalline orientation in LD//<111>, where non-uniform deformation easily occurs.

The present inventor has found with respect to the crystal orientation distribution of the main surface of the aluminum alloy material, based on such findings, that (1) the crystalline orientation in LD//<111> causes bending workability of the aluminum alloy material strongly deformed to be deteriorated, and (2) a high-strength material can be significantly improved in bending workability by not only decreasing the crystalline orientation in LD//<111>, but also increasing the rate of the crystalline orientation in LD//<100>.

In particular, in a case where a crystal is oriented in LD//<100> in the texture of the main surface of the aluminum alloy material, the difference in geometric alignment of crystal slip allows for not only a decrease in the amount of slip deformation of the crystal, but also remarkable occurrence of intersection slip, as compared with a case where such a crystal is oriented in LD//<111>. Such two actions allow the rate of working hardening in bending deformation to be considerably reduced. Such continuous working hardening enables a plastic instability phenomenon to be remarkably suppressed and enables the occurrence of cracks to be prevented.

In the present disclosure, the following is performed based on the above: not only cold working [1] is performed so that the final degree of working (total degree of working) is 3 or more, from the viewpoint of an improvement in strength, but also the degree of working per cold working [1] is set to 1.2 or less and a stable heat treatment at a treatment temperature of 50 to 80° C. for a retention time of 2 to 10 hours is performed after cold working [1], from the viewpoint of keeping and enhancing of bending workability. Specifically, a set of treatments, including [1] cold working at a degree of working of 1.2 or less and [2] a stabilizing heat treatment at a treatment temperature of 50 to 80° C. for a retention time of 2 to 10 hours, is defined as one set, and is performed repeatedly for three or more sets in the listed order, thereby making the total degree of working in the cold working [1] 3.0 or more.

In the present disclosure, the cold working [1] where the degree of working per such cold working is 1.2 or less is performed three or more times, thereby making the total of the degree of working (total degree of working) 3.0 or more. In particular, the total degree of working can be increased to thereby allow the division of the metal crystal involving deformation of the metallographic structure to be promoted, resulting in introduction of the crystal grain boundary into the aluminum alloy material at a high density. As a result, the strength of the aluminum alloy material is significantly improved. The total degree of working is preferably 4.5 or more, more preferably 6.0 or more, still more preferably 7.5 or more, most preferably 8.5 or more. The upper limit of the total degree of working is not particularly prescribed, and is usually 15.

A degree of working $\eta$ is represented by the following formula (1) under the assumption that a cross-sectional area before working is designated as s1 and a cross-sectional area after working is designated as s2 (s1> s2).

$$\text{Degree of working (non-dimension): } \eta = \ln(s1/s2) \quad (1)$$

It is preferable that the desired degree of working of one cold working [1] reaches a degree of working of 1.2 or less through a plurality of passes. For example, the degree of working can be controlled to a desired degree of working of 1.2 or less by setting such cold working at a reduction of area of 10 to 25% per pass and performing such cold working for about 6 to 12 passes. The lower limit of the degree of working per cold working [1] is not particularly limited, but is preferably 0.6 from the viewpoint of properly promoting the division of the metal crystal.

A working method may be appropriately selected according to the intended shape (a wire bar, a plate, a strip, foil, or the like) of the aluminum alloy material, and examples thereof include a cassette roller die, groove roll rolling, round wire rolling, drawing working with a die, and swaging. Various conditions (kind of lubricating oil, working speed, working heat generation, and the like) in the above working may be appropriately adjusted in known ranges.

The aluminum alloy material is not particularly limited as long as it has the above alloy composition. For example, it is possible to appropriately select and use an extruded material, an ingot material, a hot-rolled material, a cold-rolled material, and the like according to the purpose of use.

In the present disclosure, cold working [1] where the degree of working per such cold working is 1.2 or less is performed three or more times, and a predetermined stabilizing heat treatment [2] is performed after each cold working [1]. Such stabilizing heat treatments [2] are frequently introduced between multiple times of cold working [1], thereby exerting the effect of preventing crystal rotation (orientation) of LD//<111>, occurring in crystalline orientation due to usual deformation, to thereby promote crystal rotation (orientation) of LD//<100>. The treatment temperature in such a stabilizing heat treatment [2] is 50 to 80° C. In a case where the treatment temperature of such a stabilizing heat treatment [2] is less than 50° C., the above effect is less likely obtained, and in a case where the treatment temperature is more than 80° C., the density of the crystal grain boundary is decreased to result in deterioration in strength. The retention time of such a stabilizing heat treatment [2] is preferably 2 to 10 hours. The various conditions of such a heat treatment can be appropriately adjusted according to the kind and amount of inevitable impurities, and the solid solution/precipitation state of the aluminum alloy material.

In the present disclosure, the aging precipitation heat treatment [0] which has been conventionally performed before the cold working [1] is not performed. Such an aging precipitation heat treatment [0] allows the aluminum alloy material to be retained usually at 160 to 240° C. for 1 minute to 20 hours, to promote precipitation of a Mg—Si compound. In a case where the aluminum alloy material, however, is subjected to such an aging precipitation heat treatment [0], the cold working [1] at a high total degree of working cannot be performed because working cracks are generated in the material.

In the present disclosure, the refine annealing [3] may be performed as a final treatment of the aluminum alloy material for the purposes of release of residual stress and an improvement in elongation. In a case where the refine annealing [3] is performed, the treatment temperature is set to 50 to 160° C. In a case where the treatment temperature of the refine annealing [3] is less than 50° C., the above effect is less likely obtained, and in a case where treatment temperature is more than 160° C., recovery or recrystallization causes the growth of the crystal grains to occur, resulting in deterioration in strength. The retention time of the refine annealing [3] is preferably 1 to 48 hours. The various conditions of such a heat treatment can be appropriately adjusted according to the kind and amount of inevitable impurities, and the solid solution/precipitation state of the aluminum alloy material.

In the present disclosure, as described above, the aluminum alloy material is subjected to working at a high degree of working by a method such as drawing using a die, or rolling. Therefore, as a result, an elongated aluminum alloy material is obtained. On the other hand, a conventional method for manufacturing an aluminum alloy material such as powder sintering, compression torsion working, high pressure torsion (HPT), forge working, or equal channel angular pressing (ECAP) makes it difficult to provide the elongated aluminum alloy material. The aluminum alloy material of the present disclosure is preferably manufactured so as to have a length of 10 m or more. The upper limit of the length of the aluminum alloy material during manufacturing is not particularly provided, but is preferably 6000 m in consideration of workability or the like.

It is effective with respect to the aluminum alloy material of the present disclosure to increase the degree of working for refinement of the crystal grains, as described above. Thus, the configuration of the present disclosure is easily attained as the diameter of the aluminum alloy material of the present disclosure is smaller in a case of production of the aluminum alloy material as a wire rod or a bar, or as the thickness of the aluminum alloy material is smaller in a case of production of the aluminum alloy material as a plate or foil.

In particular, in a case where the aluminum alloy material of the present disclosure is a wire rod, the wire diameter is preferably 2 mm or less, more preferably 1 mm or less, still more preferably 0.4 mm or less, particularly preferably 0.2 mm or less. The lower limit is not particularly provided, but is preferably 0.01 mm in consideration of workability or the like. The aluminum alloy wire bar of the present disclosure has one advantage of being usable as a thin single wire because of having a high strength even if being a fine wire.

In a case where the aluminum alloy material of the present disclosure is a bar, the wire diameter, or the length of one side may be any value as long as the same degree of working as that of the wire rod is obtained, and is, for example, 25 mm or less, more preferably 20 mm or less, still more preferably 15 mm or less, particularly preferably 10 mm or less.

In a case where the aluminum alloy material of the present disclosure is a plate, the thickness of the plate is preferably 2 mm or less, more preferably 1 mm or less, still more preferably 0.4 mm or less, particularly preferably 0.2 mm or less. The lower limit is not particularly provided, but is preferably 0.01 mm. The aluminum alloy plate of the present disclosure has one advantage of being usable as a thin single layer because of having a high strength even in the form of a thin plate or foil.

While the aluminum alloy material of the present disclosure is slimly or thinly worked, as described above, a plurality of such aluminum alloy materials can be prepared and joined to provide a large or thick product, and such a product can be used for the intended application. A known method can be used for a joining method, and examples thereof include pressure welding, welding, joining using an adhesive, and friction stirring joining. In a case where the aluminum alloy material is a wire rod, a plurality of such wire bars is bundled and twisted to provide a twisted product, and such a product can be used as an aluminum alloy twisted wire for the intended application. The step of the refine annealing [3] may be performed after the aluminum alloy material subjected to a set of treatments, including the cold working [1] and the stabilizing heat treatment [2], for three or more times, is subjected to working by joining or twisting.

(3) Organizational Feature of Aluminum Alloy Material of Present Disclosure

<Metallographic Structure>

The aluminum alloy material of the present disclosure manufactured by the above manufacturing method is made so that the crystal grain boundary is introduced at a high density into the metallographic structure. The aluminum alloy material of the present disclosure has a fibriform metallographic structure where the crystal grains extend so as to be aligned in one direction, and has an average value of the size perpendicular to the longitudinal direction of the crystal grains, of 400 nm or less, in a cross section parallel to the one direction. The aluminum alloy material has a non-conventional specific metallographic structure, and thus can exhibit a particularly excellent strength.

The metallographic structure of the aluminum alloy material of the present disclosure is a fibriform structure, and the crystal grains each having an elongated shape extend in fiber forms so as to be aligned in one direction. The "one direction" corresponds to the working direction (stretching direction) of the aluminum alloy material. For example, the "one direction" corresponds to a wire drawing direction in a case where the aluminum alloy material is a wire rod or a bar, and corresponds to a rolling direction in a case where the aluminum alloy material is a plate or foil, respectively. The aluminum alloy material of the present disclosure exhibits a particularly excellent strength particularly with respect to tensile stress parallel to the working direction.

The one direction preferably corresponds to the longitudinal direction of the aluminum alloy material. Specifically, as long as the aluminum alloy material is not divided into pieces so as to have a size shorter than a size perpendicular to the working direction, the working direction DD of the aluminum alloy material usually corresponds to the longitudinal direction LD.

The average value of the size perpendicular to the longitudinal direction of the crystal grains is 400 nm or less, more preferably 320 nm or less, still more preferably 250 nm or less, particularly preferably 220 nm or less, still more preferably 180 nm or less in the cross section parallel to the one direction. The fibriform metallographic structure where the crystal grains having a smaller diameter (size perpendicular to the longitudinal direction of the crystal grains) extend in one direction has a crystal grain boundary formed at a high density, and the metallographic structure makes it possible to effectively inhibit the crystal slip associated with deformation and to attain a non-conventional high strength. Moreover, the metallographic structure has the effect of suppressing non-uniform deformation in bending deformation by the effect of fineness of the crystal grains. A smaller average value of the size perpendicular to the longitudinal direction of the crystal grains is more preferable in terms of attainment of a high strength, and the lower limit as the limit from manufacturing or physical perspective is, for example, 50 nm.

The size of the longitudinal direction of the crystal grains is not necessarily specified, but is preferably 1200 nm or more, more preferably 1700 nm or more, still more preferably 2200 nm or more. The aspect ratio of the crystal grains is preferably 10 or more, more preferably 20 or more.

<Texture>

The main surface of the aluminum alloy material of the present disclosure manufactured by the above manufacturing method has a texture where the crystal orientation distribution is controlled so that the crystalline orientation in LD//<111> is suppressed and the crystalline orientation in LD//<100> is increased. The main surface of the aluminum alloy material of the present disclosure has a crystal orientation distribution which satisfies a peak intensity ratio R ($I_{200}/I_{220}$) of the peak intensity $I_{200}$ of the diffraction peak due to the {100} plane of a crystal to the peak intensity $I_{220}$ of the diffraction peak due to the {110} plane of a crystal, of 0.20 or more, determined by an X-ray diffraction method. The main surface of the aluminum alloy material has a non-conventional specific texture, thereby enabling particularly excellent bending workability to be exhibited.

The peak intensity $I_{200}$ of the diffraction peak due to the {100} plane and the peak intensity $I_{220}$ of the diffraction peak due to the {110} plane, analyzed in the present disclosure, are determined from an X-ray diffraction pattern obtained by subjecting the main surface of the aluminum alloy material to an X-ray diffraction method using Cu—Kα beam.

Figure 4A:
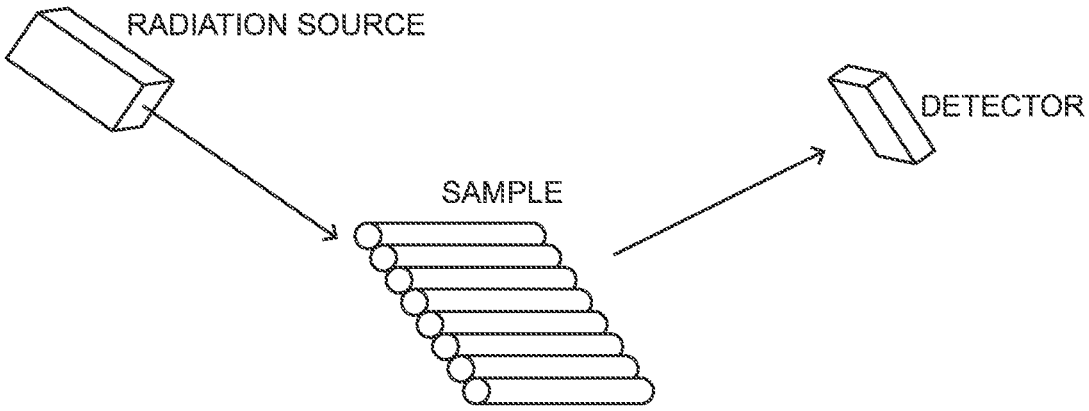
FIGS. 4A and 4B are views illustrating one example in measurement of the main surface of an aluminum alloy wire rod by an X-ray diffraction method. In particular, FIG. 4A schematically illustrates the location of samples in such measurement.
Figure 4B:
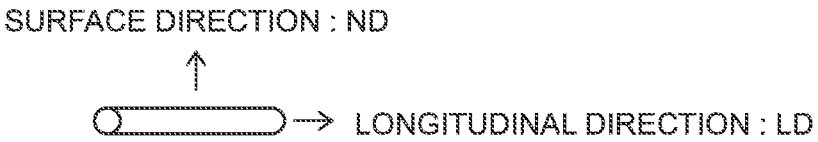

FIG. 4 illustrates a schematic view in measurement to be performed on the surface of an aluminum alloy wire rod, by an X-ray diffraction method, as one example. The main surface of the aluminum alloy material is subjected to measurement by an X-ray diffraction method, in the present disclosure. Thus, in a case where the aluminum alloy material is a wire rod, a glass plate is lined with a wire road-shaped sample to provide each sample for X-ray measurement, as illustrated in FIG. 4A Furthermore, such a sample for measurement is disposed so that an X-ray path is parallel to the longitudinal direction LD (wire drawing direction DD) of the wire rod, as illustrated in FIG. 4A. The normal direction ND is a direction perpendicular to the main surface (surface parallel to LD) of the aluminum alloy wire rod, as illustrated in FIG. 4B. Specifically, ND and LD are in a perpendicular relationship. Detailed measurement conditions are described in the section of Examples to be described below.

The present disclosure focuses on the diffraction peak due to the {100} plane of a crystal and the diffraction peak due to the {110} plane of a crystal in the X-ray diffraction pattern obtained by subjecting the main surface of the aluminum alloy material to measurement.

The X-ray diffraction peak due to the {100} plane in the main surface of the aluminum alloy material means the existence of a crystal where the {001} plane of such a crystal is orientated in ND (ND and the <001> direction are parallel to each other, hereinafter, designated as "ND//<001>") in the surface layer portion of the main surface of the aluminum alloy material. The X-ray diffraction peak due to the {110} plane also means the existence of a crystal where the {110} plane of such a crystal is orientated in ND (ND and the <110> direction are parallel to each other, hereinafter, designated as "ND//<110>") in the surface layer portion of the main surface of the aluminum alloy material, as in the above.

Figure 5:
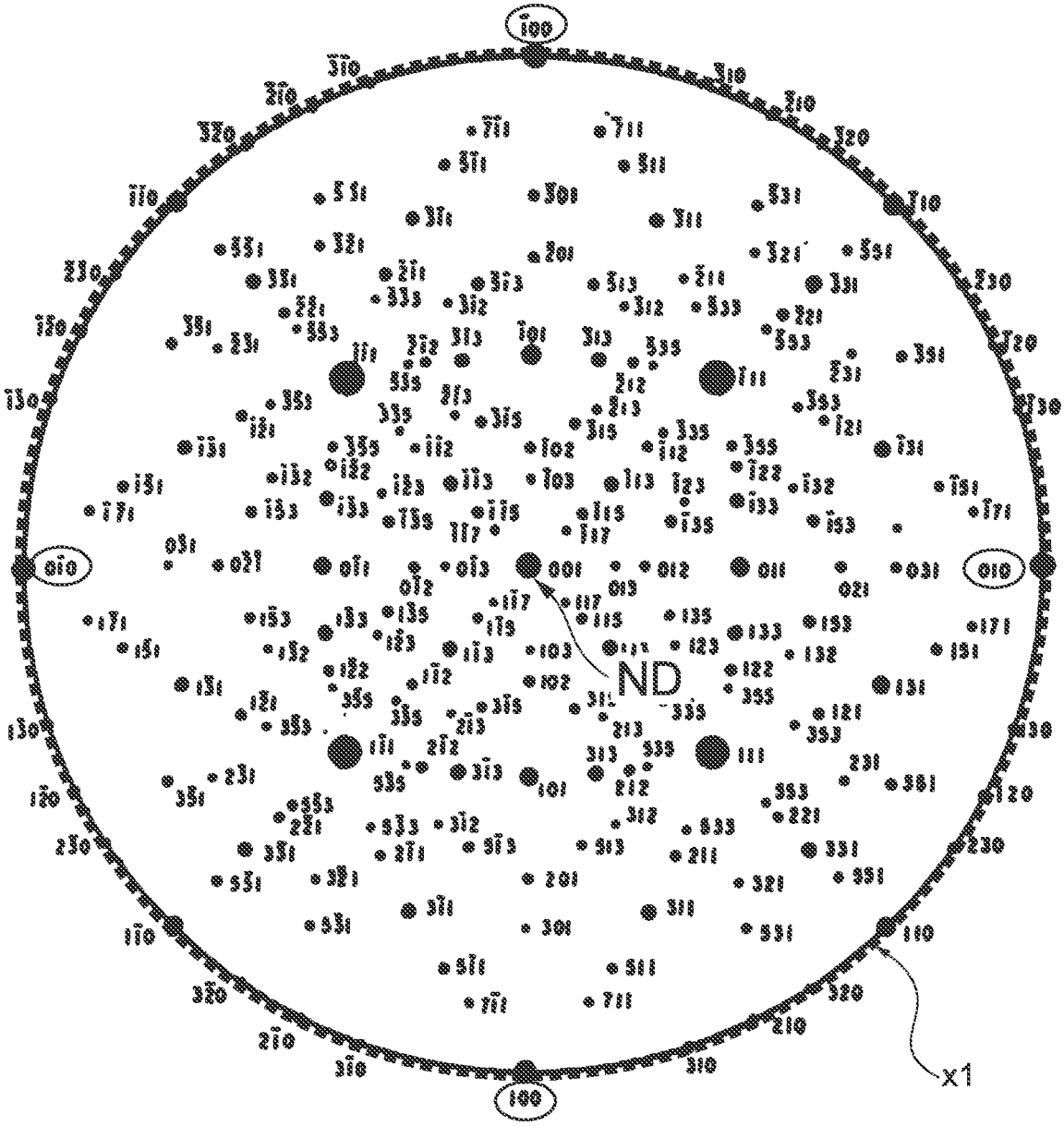
FIG. 5 is a (001) standard projection.
Figure 6:
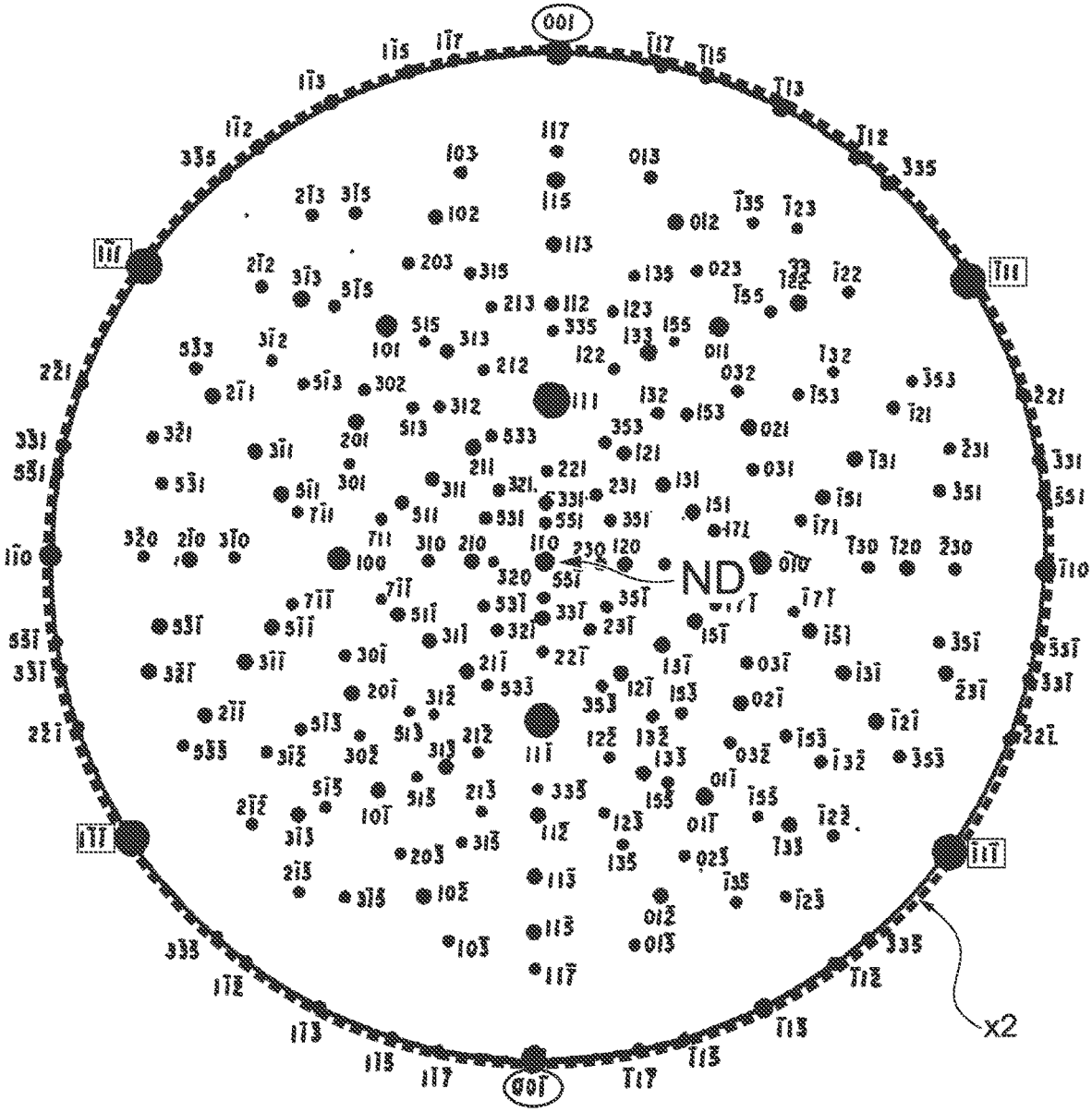
FIG. 6 is a (110) standard projection.

FIGS. 5 and 6 illustrate a (001) standard projection and a (110) standard projection, respectively. Herein, a dotted line x1 of FIG. 5 indicates a direction orthogonal to the <001> direction, and a dotted line x2 of FIG. 6 indicates a direction orthogonal to the <110> direction.

ND and LD are in an orthogonal relationship as described above (see FIG. 4B), and thus the crystalline orientation in ND//<001> is a crystalline orientation where a crystal plane connecting the {100} plane to the {310} plane to the {210} plane to the {320} plane to the {110} plane is oriented in LD, as illustrated in FIG. 5. In particular, such a crystal plane located around the {110} plane corresponds to an unstable orientation with a decrease due to deformation, and thus it is considered that a crystal counted as the crystalline orientation in ND//<001> in X-ray diffraction measurement is substantially a crystal where a crystal plane located around the {100} plane is oriented in LD.

Similarly, the crystalline orientation in ND//<110> is a crystalline orientation where a crystal plane connecting the {100} plane to the {117} plane to the {115} plane to the {113} plane to the {112} plane to the {335} plane to the {111} plane to the {221} plane to the {331} plane to the {551} plane to the {110} plane is oriented in LD, as illustrated in FIG. 6. In particular, the {221} plane to the {331} plane to the {551} plane to the {110} plane correspond to unstable orientations with a decrease due to deformation and a crystal plane connecting the {100} plane to . . . to the {111} plane corresponds to a stable orientation due to deformation, and thus it is considered that a crystal counted as the crystalline orientation in ND//<110> in X-ray diffraction measurement is a crystal where a crystal plane connecting the {100} plane to . . . to the {111} plane is oriented in LD.

Specifically, the parameter (the peak intensity ratio R ($I_{200}/I_{220}$) of the peak intensity $I_{200}$ of the diffraction peak due to the {100} plane to the peak intensity $I_{220}$ of the diffraction peak due to the {110} plane, obtained from the X-ray diffraction pattern obtained by subjecting the main surface of the aluminum alloy material to measurement), on which the present disclosure focuses, corresponds to the proportion of a crystal whose {100} plane is oriented in LD (oriented in LD//<100>) in the total crystal stably oriented due to deformation, in the main surface of the aluminum alloy material.

As described above, the crystalline orientation in LD//<111> causes bending workability of the aluminum alloy material strongly deformed to be deteriorated in the main surface. Therefore, it is desirable from the viewpoint of an improvement in bending workability to not only decrease the crystalline orientation in LD//<111>, but also increase the rate of the crystalline orientation in LD//<100>, with respect to the texture of the main surface.

In a case where the crystal orientation distribution of the main surface is reviewed from such a viewpoint, no {111} plane is oriented in LD (see FIG. 5) and a crystal plane located around a comparatively stable {100} plane is oriented in LD, in the crystalline orientation in ND//<001>, as described above. It is thus desirable with focusing on ND to increase the rate of the crystalline orientation in ND//<001> in the crystal orientation distribution of the main surface.

Accordingly, it is important that the texture of the main surface of the aluminum alloy material of the present disclosure satisfy a peak intensity ratio R ($I_{200}/I_{220}$) of 0.20 or more. Such R satisfying the range means a high rate of the crystalline orientation in ND//<001>, specifically, a high rate of the crystalline orientation in LD//<100> contributing to an improvement in bending workability and a low rate of the crystalline orientation in LD//<111> deteriorating bending workability, in the surface layer portion of the main surface of the aluminum alloy material, and thus excellent bending workability is exhibited. More favorable bending workability is obtained as the rate of the crystalline orientation in LD//<111> is lower and the rate of the crystalline orientation in LD//<100> is higher in the orientation of a crystal of the main surface, and thus a larger peak intensity ratio R ($I_{200}/I_{220}$) is more preferable, and such a ratio is more preferably 0.30 or more, still more preferably 0.45 or more, particularly preferably 0.60 or more, further preferably 0.75 or more. The upper limit of R is not particularly limited, but is, for example, 2.0.

(4) Characteristics of Aluminum Alloy Material of Present Disclosure

[Tensile Strength]

A tensile strength is measured according to JIS Z2241: 2011. Detailed measurement conditions are described in the section of Examples to be described below.

In a case where the aluminum alloy material of the present disclosure is particularly a wire rod or a bar, the aluminum alloy material preferably has a tensile strength of 370 MPa or more. Such a tensile strength exceeds 330 MPa which corresponds to the tensile strength of A6201 having the highest strength, among conducting aluminum alloys shown in ASTM INTERNATIONAL, by one tenth or more (standard name: B398/B398 m-14). Accordingly, for example, in a case where the aluminum alloy material of the present disclosure is applied to a cable, the following effect is obtained: the conductor of such a cable has a cross-sectional area and a weight reduced by one tenth, while such a cable maintains a high tensile force. A more preferable tensile strength is 430 MPa or more. Such a tensile strength corresponds to an average value in a tensile strength range of a hard copper wire shown in ASTM INTERNATIONAL (standard name: B1-13). Accordingly, for example, the aluminum alloy material of the present disclosure can be suitably used in an application where a hard copper wire is used, and has the effect of substituting a hard copper wire therewith. A further preferable tensile strength is 480 MPa or more, and such a tensile strength exceeds 460 MPa which is the maximum value with respect to the hard copper wire. A particularly preferable tensile strength is 540 MPa or more, such a tensile strength is, for example, a strength comparable to those of high-strength aluminum alloys of 2000-series and 7000-series, and the aluminum alloy material can substitute such aluminum alloys inferior in corrosion resistance and moldability therewith. The aluminum alloy material can also be used as substitution of various steel-based or stainless steel-based materials. A further more preferable tensile strength is 600 MPa or more. The aluminum alloy material of the present disclosure, which has such a high strength, can be used as substitution of a strong wire drawing worked material made of a thin copper alloy such as a Cu—Sn-based or a Cu—Cr-based alloy. The upper limit of the tensile strength of the aluminum alloy material of the present disclosure is not particularly limited, but is, for example, 1000 MPa.

The aluminum alloy material of the second embodiment of the present disclosure can maintain the above high tensile strength even after heating. In particular, the tensile strength measured after heating at 110° C. for 24 hours is preferably 340 MPa or more, more preferably 370 MPa or more, still more preferably 420 MPa or more.

[Vickers Hardness (HV)]

A Vickers hardness (HV) is a value measured according to JIS Z2244: 2009. Detailed measurement conditions are described in the section of Examples to be described below. The Vickers hardness (HV) of a worked product already formed into a component can be measured by disassembling the worked product, and subjecting a cross section of the product to mirror polishing and subjecting the cross section to measurement.

In a case where the aluminum alloy material of the present disclosure is particularly a wire rod or a bar, the aluminum alloy material preferably has a Vickers hardness (HV) of 100 or more. Such a Vickers hardness (HV) exceeds 90 which corresponds to the Vickers hardness (HV) of A6201 having the highest strength, among conducting aluminum alloys shown in ASTM INTERNATIONAL, by one tenth or more (standard name: B398/B398 m-14). Accordingly, for example, in a case where the aluminum alloy material of the present disclosure is applied to a cable, the following effect is obtained: the conductor of such a cable has a cross-sectional area and a weight reduced by one tenth, while such a cable maintains a high tensile force. A more preferable Vickers hardness (HV) is 115 or more. Such a Vickers hardness (HV) corresponds to a moderate HV of a hard copper wire shown in ASTM INTERNATIONAL (standard name: B1-13). Accordingly, for example, the aluminum alloy material of the present disclosure can be suitably used in an application where a hard copper wire is used, and has the effect of substituting a hard copper wire therewith. A further preferable Vickers hardness (HV) is 130 or more, and such a Vickers hardness (HV) exceeds 125 which is the maximum value with respect to the hard copper wire. A particularly preferable Vickers hardness (HV) is 145 or more, such a Vickers hardness (HV) is, for example, a strength comparable to those of high-strength aluminum alloys of 2000-series and 7000-series, and the aluminum alloy material can substitute such aluminum alloys inferior in corrosion resistance and moldability therewith. The aluminum alloy material can also be used as substitution of various steel-based or stainless steel-based materials. A further more preferable Vickers hardness (HV) is 160 or more. The aluminum alloy material of the present disclosure, which has such a high strength, can be used as substitution of a strong wire drawing worked material made of a thin copper alloy such as a Cu—Sn-based or a Cu—Cr-based alloy. The upper limit of the Vickers hardness (HV) of the aluminum alloy material of the present disclosure is not particularly limited, but is, for example, 250.

[Bending Workability]

Bending workability is evaluated by performing a W bending test according to JIS Z 2248: 2006. Detailed measurement conditions are described in the section of Examples to be described below.

In a case where the aluminum alloy material of the present disclosure is particularly a wire rod or a bar, the limit inner bending radius according to the W bending test is preferably 30 to 70% relative to the wire diameter. The limit inner bending radius refers to a limit bending radius where no cracks are generated in inner bending as in that according to the W bending test. The aluminum alloy material of the present disclosure, which has the limit inner bending radius, is excellent in workability in, for example, molding of a wire rod into a three-dimensional structure by a method for knitting, weaving, tying, jointing, connecting, or the like.

(5) Covering of Aluminum Alloy Material of Present Disclosure with Metal

The aluminum alloy material of the present disclosure may be covered with at least one metal selected from the group consisting of Cu, Ni, Ag, Sn, Au and Pd. Examples of such a metal also include an alloy or an intermetallic compound containing Cu, Ni, Ag, Sn, Au and/or Pd as main constituent element(s). The aluminum alloy material of the present disclosure can be covered with such a metal, resulting in improvements in contact resistance, solder wettability, corrosion resistance, and the like.

A method for covering the aluminum alloy material of the present disclosure with the metal is not particularly limited, and examples thereof include immersion plating, electrolytic plating, clad, and thermal spraying. It is preferable with respect to such covering with the metal that the thickness of the covering with the metal be thin from the viewpoint of a reduction in weight, and the like. Thus, immersion plating and electrolytic plating are particularly preferable among the above methods. The aluminum alloy material may be covered with the metal and then further subjected to wire drawing working. In a case where the orientation of a crystal of the aluminum alloy material of the present disclosure, covered with the metal, is measured by X-ray or the like, the surface of the aluminum alloy material is subjected to such measurement after the covering with the metal is removed.

Figure 7B:
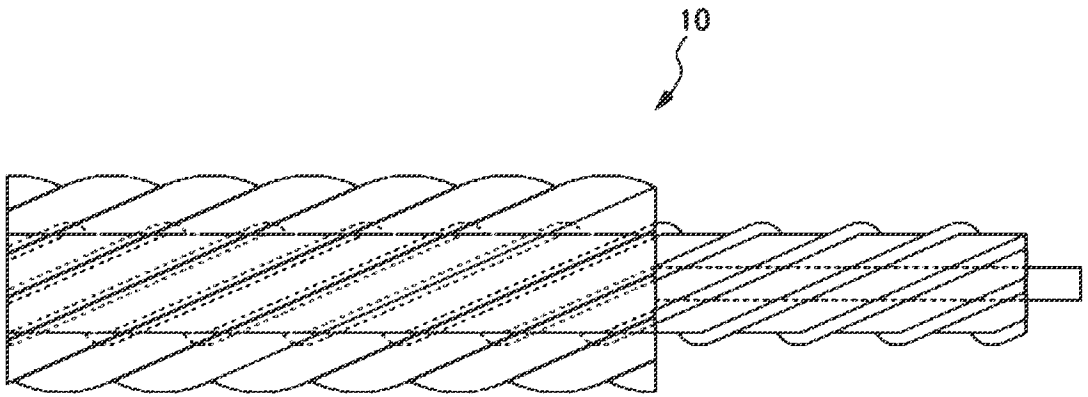
FIGS. 7A and 7B are views illustrating one embodiment of a twisted wire structure of the aluminum alloy material of the present disclosure and other wire rod.
Figure 7A:
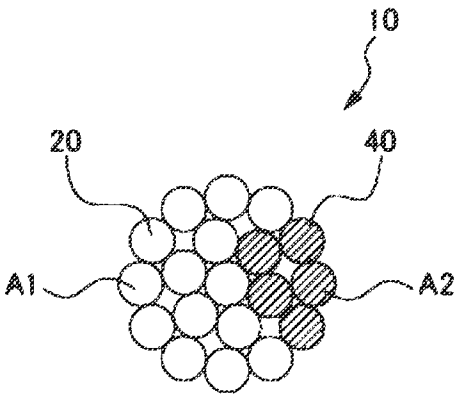

(6) Twisted Wire Structure of Aluminum Alloy Material of Present Disclosure and Other Wire Rod The aluminum alloy material of the present disclosure may have a twisted wire structure twisted with other metal material such as copper, copper alloy, aluminum, aluminum alloy, iron, an iron alloy, or the like. Such a twisted wire structure is formed in a state where a conductor formed by the aluminum alloy material of the present disclosure and a conductor formed by such other metal material are twisted and mixed. FIG. 7 schematically illustrates one embodiment of a twisted wire structure with the aluminum alloy material of the present disclosure, and FIG. 7A is a transverse cross-sectional view and FIG. 7B is a plan view.

As illustrated in FIG. 7, a twisted wire structure 10 is formed by a first conductor 20 produced from the aluminum alloy material of the present disclosure, and a second conductor 40 produced from other metal material such as copper, a copper alloy, aluminum, an aluminum alloy, iron, or an iron alloy. An embodiment illustrated in FIG. 7 presents a concentric twisted wire formed by a 1×19 twisted structure obtained by twisting all nineteen conductors in total of fourteen first conductors 20 and five second conductors 40 together at the same pitch in an S twisting (clockwise twisting) direction, in which the first conductors 20 and the second conductors 40 used have the same wire diameter.

The twisted wire structure 10 can be formed by using two kinds of conductors (first conductor 20 and second conductor 40) different in properties from each other, and twisting such conductors 20 and 40 together and mixing them, and thus can also have a high conductivity and a high strength, also have excellent bending fatigue resistance, and furthermore can also achieve a reduced weight.

The first conductors 20 and the second conductors 40 may be the same as or different from each other in terms of the diameter (wire diameter) size. For example, in a case where fatigue life is focused on, it is preferable that the first conductors 20 and the second conductors 40 be the same as each other in terms of the diameter size. In a case where reductions in gaps between conductors forming the twisted wire structure, and between such a conductor and a covering are focused on, it is preferable that the first conductors 20 and the second conductors 40 be different from each other in terms of the diameter size.

While FIG. 7 illustrates an example of the twisted wire conductor 10 formed by a 1×19 twisted structure obtained by twisting a predetermined number of the first conductors 20 and a predetermined number of the second conductors 40 together at the same pitch in an S twisting direction (right twisting), the twisted wire structure 10 may be formed so that the first conductors 20 and the second conductors 40 are twisted together and mixed. Thus, conditions, for example, the type of the twisted wire (for example, an aggregated twisted wire, a concentric twisted wire, or a rope twisted wire), the twisting pitch (for example, any conductor located in an inner layer and any conductor located in an outer layer are the same as or different from each other in terms of the pitch), the twisting direction (for example, S twisting, Z twisting, intersection twisting, or parallel twisting), the twisting structure (1×7, 1×19, 1×37, 7×7, or the like), and the wire diameter (for example, a diameter of 0.07 to 2.00 mm), are not particularly limited, and the twisted wire structure 10 can be appropriately changed in design depending on the intended application. For example, various twisted structures are described in "600V Rubber Cabtyre cable" of JIS C3327: 2000.

Figure 8A:
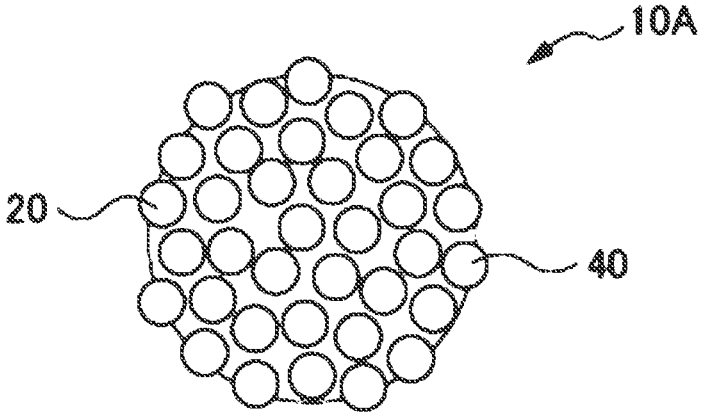
FIGS. 8A, 8B and 8C are cross-sectional views each schematically illustrating other embodiments of the twisted wire structure in FIGS. 7A and 7B.
Figure 8B:
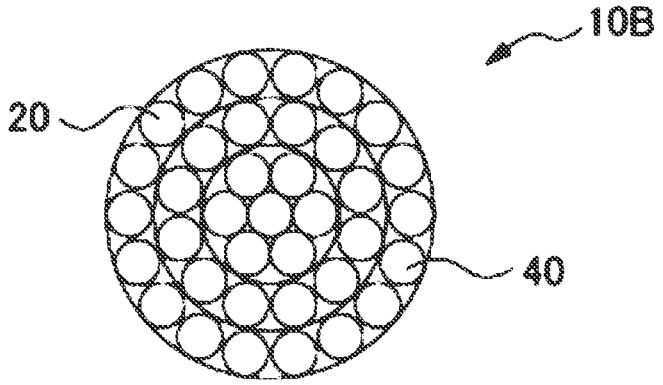
Figure 8C:
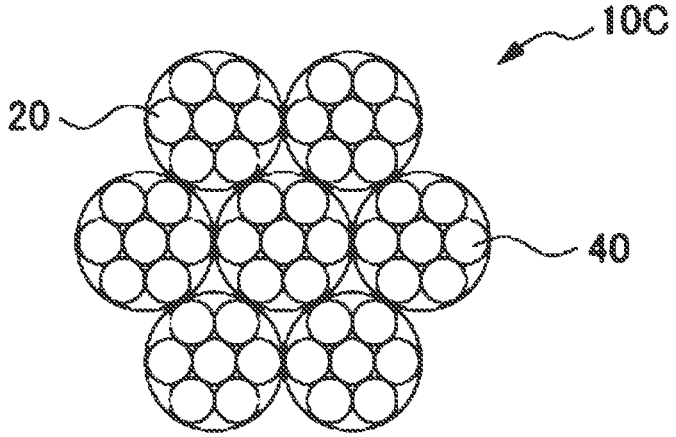

The twisted structure of the twisted wire structure 10 may be formed as an aggregated twisted wire by twisting thirty-six in total of conductors (first conductors and second conductors) bundled, together in one direction, as illustrated in, for example, FIG. 8A. As illustrated in FIG. 8B, the twisted structure may also be formed as a concentric twisted wire having a 1×37 structure by twisting thirty-seven in total of conductors (first conductors and second conductors) together in an alignment where one conductor serves as a center, and six, twelve, and eighteen conductors are sequentially disposed around the conductor. Furthermore, as illustrated in FIG. 8C, the twisted structure may also be formed as a rope twisted wire having a 7×7 structure by bundling and twisting seven twisted wires having a 1×7 structure where one conductor of seven conductors (first conductors and second conductors) serves as a center and six conductors are twisted together around the conductor. FIGS. 8A to 8C illustrate both the first conductors and the second conductors, although both are not distinguished. The placement relationship between the first conductors 20 and the second conductors 40 forming the twisted wire structure 10 is not particularly limited, and, for example, the first conductors 20 may be disposed inwardly or outwardly relative to the twisted wire structure 10, or may be randomly disposed inwardly and outwardly relative to the twisted wire structure 10.

(7) Application of Aluminum Alloy Material of Present Disclosure

The aluminum alloy material of the present disclosure can be directed to all the applications in which an iron-based material, a copper-based material, and an aluminum-based material are used. Specifically, the aluminum alloy material can be suitably used as a conductive member such as an electric wire or a cable, a battery member such as a current collector mesh or net, a fastening component such as a screw, a bolt, or a rivet, a spring component such as a coil spring, an electric contact spring member such as a connector or a terminal, a structural component such as a shaft or a frame, a guide wire, a semiconductor bonding wire, a winding wire used for a dynamo or a motor, or the like.

More specific application examples of the conductive member include a power electric wire such as an overhead power line, OPGW (optical-fiber composite overhead ground wire), a subterranean electric wire, or a submarine cable, a communication electric wire such as a telephone cable or a coaxial cable, an appliance electric wire such as a wired drone cable, a data transmission cable, a cab tire cable, an EV/HEV charge cable, a twisted cable for wind power generation on the ocean, an elevator cable, an umbilical cable, a robot cable, a train overhead wire, or a trolley wire, a transportation electric wire such as an automobile wire harness, a vessel electric wire, and an airplane electric wire, a bus bar, a lead frame, a flexible flat cable, a lightning rod, an antenna, a connector, a terminal, and a cable braid.

In recent years, a copper wire having a braided structure has been used as a shielded wire in a data transmission cable, according to progression of the advanced information society. Such a shielded wire can also be reduced in weight due to the aluminum alloy material of the present disclosure.

Examples of the battery member include a solar cell electrode.

More specific application examples of the structural member include a scaffold in a construction site, a conveyor mesh belt, a clothing metal fiber, a chain armor, a fence, an insect repellent net, a zipper, a fastener, a clip, aluminum wool, a bicycle component such as a brake wire or a spoke, a reinforcement wire for tempered glass, a pipe seal, a metal packing, a protection reinforcing material for a cable, a fan belt cored bar, a wire for driving an actuator, a chain, a hanger, a sound isolation mesh, and a shelf board.

More specific application examples of the fastening member include a set screw, a staple, and a drawing pin.

More specific application examples of the spring member include a spring electrode, a terminal, a connector, a semiconductor probe spring, a blade spring, and a flat spiral spring.

The aluminum alloy material is also suitable as a metal fiber to be added in order to apply conductivity to a resin-based material, a plastic material, a cloth, and the like, and to control the strength and elastic modulus thereof.

The aluminum alloy material is also suitable as a consumer member and a medical member such as an eyeglass frame, a dock belt, a nib of a fountain pen, a fork, a helmet, or an injection needle.

Embodiments of the present disclosure are described above, but the present disclosure is not limited to the above embodiments, and includes all aspects included in the concept of the present disclosure and appended claims, and various modifications can be made within the scope of the present disclosure.

EXAMPLES

Next, Examples and Comparative Examples are described to further clarify the effects of the present disclosure, but the present disclosure is not limited to these Examples.

Examples 1 to 12

First, respective bars having a diameter of 10 mm and having any alloy composition shown in Table 1, specifically, the alloy composition of the first embodiment were prepared. Next, such bars were used to produce respective aluminum alloy wire rods (diameter: 0.07 to 2.0 mm) under manufacturing conditions shown in Table 1.

Comparative Example 1

A bar having a diameter of 10 mm and including 99.99% by mass-Al was used to produce an aluminum wire rod (diameter: 0.24 mm) in a manufacturing condition shown in Table 1, in Comparative Example 1.

Comparative Examples 2 to 4

Respective bars having a diameter of 10 mm and having any alloy composition shown in Table 1 were used to produce aluminum alloy wire rods (diameter: 0.07 to 2.0 mm) under manufacturing conditions shown in Table 1, in Comparative Examples 2 to 4.

Manufacturing conditions A to H shown in Table 1 are specifically as follows.

<Manufacturing Condition A>

The bar prepared was subjected to treatments including cold working [1] at a degree of working of 1.1 and a stabilizing heat treatment [2] at 65° C. for 6 hours which were to be performed in the listed order (hereinafter, referred to as "set A of treatments"), for three sets (total degree of working of cold working [1]: 3.3). The bar was not subjected to refine annealing [3].

<Manufacturing Condition B>

The bar was subjected to set A of treatments under the same conditions as manufacturing condition A except that set A of treatments was performed for five sets (total degree of working of cold working [1]: 5.5).

<Manufacturing Condition C>

The bar was subjected to set A of treatments under the same conditions as manufacturing condition A except that set A of treatments was performed for seven sets (total degree of working of cold working [1]: 7.7).

<Manufacturing Condition D>

The bar was subjected to set A of treatments under the same conditions as manufacturing condition A except that set A of treatments was performed for nine sets (total degree of working of cold working [1]: 9.9).

<Manufacturing Condition E>

The bar prepared was subjected to set A of treatments for three sets (total degree of working of cold working [1]: 3.3), and thereafter subjected to refine annealing [3] in conditions of a treatment temperature of 140° C. and a retention time of 1 hour.

<Manufacturing Condition F>

The bar was subjected to set A of treatments under the same conditions as manufacturing condition E except that set A of treatments was performed for five sets (total degree of working of cold working [1]: 5.5).

<Manufacturing Condition G>

The bar was subjected to set A of treatments under the same conditions as manufacturing condition A except that set A of treatments was performed for two sets (total degree of working of cold working [1]: 2.2).

<Manufacturing Condition H>

The bar prepared was subjected to cold working [1] at a degree of working of 7.7. The bar was not subjected to stable heat treatment [2] and refine annealing [3].

(Comparative Examples 5 and 6): Manufacturing Condition I of Table 1

Each of the bars having an alloy composition shown in Table 1 was subjected to set A of treatments for one to three sets, but wire breaking frequently occurred halfway and thus the work was stopped.

(Comparative Example 7): Manufacturing Condition J of Table 1

The bar having an alloy composition shown in Table 1 was subjected to aging precipitation heat treatment [0] at a treatment temperature of 180° C. for retention time of 10 hours and then subjected to set A of treatments for two sets, but wire breaking frequently occurred halfway and thus the work was stopped.

(Comparative Example 8): Manufacturing Condition K of Table 1

An Al bare metal for electricity (JIS H 2110), an Al—Mg foil alloy and an Al—Si master alloy were dissolved, to manufacture a molten metal having an alloy composition of Al-0.7% by mass Mg-0.7% by mass Si. After the molten metal obtained was cast, a billet having a diameter of 60 mm and a length of 240 mm was hot extruded at 470° C., to obtain a drawing stock. The drawing stock obtained was subjected to first wire drawing working at a working rate of 70% (degree of working: 1.20), and thereafter a primary heat treatment at 130° C. for 5 hours. The drawing stock was further subjected to second wire drawing working at a working rate of 60% (degree of working: 0.92), and thereafter a secondary heat treatment at 160° C. for 4 hours, to obtain an aluminum alloy wire rod (diameter: 2 mm).

(Comparative Example 9): Manufacturing Condition L of Table 1

A molten metal having an alloy composition of Al-0.51% by mass Mg-0.58% by mass Si-0.79% by mass Fe was formed into a bar having a diameter of 10 mm by a Properzi type continuous casting rolling machine. The bar obtained was peeled so as to have a diameter of 9.5 mm, and subjected to first wire drawing working at a degree of working of 2.5, thereafter a primary heat treatment at 300 to 450° C. for 0.5 to 4 hours, furthermore second wire drawing working at a degree of working of 4.3, thereafter a secondary heat treatment in a continuous current heat treatment at 612° C. for 0.03 seconds (corresponding to refine annealing [3]), and furthermore an aging heat treatment at 150° C. for 10 hours, to obtain an aluminum alloy wire rod (diameter: 0.31 mm).

(Comparative Example 10): Manufacturing Condition M of Table 1

Aluminum having a purity of 99.95% by mass, magnesium having a purity of 99.95% by mass, silicon having a purity of 99.99% by mass, and iron having a purity of 99.95% by mass were charged into a graphite crucible in respective predetermined amounts, and stirred and molten at 720° C. by high-frequency induction heating, to manufacture a molten metal having an alloy composition of Al-0.6% by mass Mg-0.3% by mass Si-0.05% by mass Fe. The molten metal obtained was moved to a container provided with a graphite die, and subjected to continuous casting at a casting speed of about 300 mm/min via the water-cooled graphite die, to obtain a wire having a diameter of 10 mm and a length of 100 mm. A cumulative equivalent strain of 4.0 was introduced by the ECAP (Equal Channel Angular Pressing) method. A recrystallization temperature obtained at this stage was 300° C. The wire was subjected to prior heating in an inactive gas atmosphere at 250° C. for 2 hours. Next, the wire was subjected to a first wire drawing treatment at a working rate of 29% (degree of working: 0.34). A recrystallization temperature obtained at this stage was 300° C. The wire was subjected to a primary heat treatment at 260° C. for 2 hours in an inactive gas atmosphere. Thereafter, the wire was allowed to pass through a water-cooled wire drawing die at a drawing speed of 500 mm/min and subjected to a second wire drawing treatment at a degree of working of 9.3. A recrystallization temperature obtained at this stage was 280° C. The wire was subjected to a secondary heat treatment in an inactive gas atmosphere at 220° C. for 1 hour, to obtain an aluminum alloy wire rod (diameter: 0.08 mm).

Examples 13 to 28

First, respective bars having a diameter of 10 mm and having any alloy composition shown in Table 2, specifically, the alloy composition of the second embodiment were prepared. Next, such bars were used to produce respective aluminum alloy wire rods (diameter: 0.07 to 2.0 mm) under manufacturing conditions shown in Table 2.

Comparative Example 11

A bar having a diameter of 10 mm and including 99.99% by mass-Al was used to produce an aluminum wire rod (diameter: 0.24 mm) in a manufacturing condition shown in Table 2, in Comparative Example 11.

Comparative Examples 12 to 14

Respective bars having a diameter of 10 mm and having any alloy composition shown in Table 2 were used to produce aluminum alloy wire rods (diameter: 0.07 to 2.0 mm) under manufacturing conditions shown in Table 2, in Comparative Examples 12 to 14.

Manufacturing conditions A to J and M shown in Table 2 are as described above.

Comparative Examples 15 to 17

Each of the bars having an alloy composition shown in Table 2 was subjected to manufacturing condition I, and wire breaking frequently occurred halfway and thus the work was stopped.

Comparative Example 18

The bar having an alloy composition shown in Table 2 was subjected to manufacturing condition J, but wire breaking frequently occurred halfway and thus the work was stopped.

(Comparative Example 19): Manufacturing Condition N of Table 2

An Al bare metal for electricity was dissolved. A Mg simple substance, an Al-25% by mass Si master alloy, an Al-6% by mass Fe alloy, an Al-50% by mass Cu master alloy, and an Al-10% by mass Cr master alloy were added thereto, and dissolved, to manufacture a molten metal having an alloy composition of Al-1.03% by mass Mg-0.90% by mass Si-0.20% by mass Fe-0.16% by mass Cu-0.15% by mass Cr. The molten metal obtained was continuously cast and rolled by a belt-and-wheel type continuous casting rolling machine, to obtain a drawing stock having a diameter of 9.5 mm. The drawing stock obtained was subjected to solution water hardening at 520° C., an artificial aging treatment for retention at 200° C. for 4 hours, wire drawing working at a working rate of 86.4% (degree of working: 2.0), and tempering at 140° C. for 4 hours, to obtain an aluminum alloy wire rod (diameter: 3.5 mm).

(Comparative Example 20): Manufacturing Condition 0 of Table 2

Aluminum for electricity having a purity of 99.8% was used, and respective materials of an Al-6% by mass Fe master alloy, an Al-50% by mass Cu master alloy, an Al-20% by mass Si master alloy, and a Mg simple substance were added thereto, to manufacture a molten metal having an alloy composition of Al-0.90% by mass Mg-0.80% by mass Si-0.20% by mass Fe-1.30% by mass Cu. The molten metal obtained was subjected to belt-and-wheel type continuous casting rolling, to obtain a drawing stock (diameter: 18 mm). The drawing stock obtained was subjected to first wire drawing working at a working rate of 47% (degree of working: 0.63) so as to have a diameter of 9.5 mm, a solution treatment at 520° C. for 2 hours and thereafter water hardening. The drawing stock was subjected to an aging treatment at 200° C. for 4 hours, furthermore second wire drawing working at a working rate of 86% (degree of working: 2.0), and a heat treatment at 140° C. for 4 hours, to obtain an aluminum alloy wire rod (diameter: 3.5 mm).

(Comparative Example 21): Manufacturing Condition P of Table 2

A molten metal having an alloy composition of Al-0.70% by mass Mg-0.69% by mass Si-1.01% by mass Fe-0.35% by mass Cu was formed into a bar having a diameter of 10 mm by a Properzi type continuous casting rolling machine. The bar obtained was peeled so as to have a diameter of 9.5 mm, and subjected to first wire drawing working at a degree of working of 2.6, thereafter a primary heat treatment at 300 to 450° C. for 0.5 to 4 hours, furthermore second wire drawing working at a degree of working of 3.6, thereafter a secondary heat treatment in a continuous current heat treatment at 555° C. for 0.15 seconds, and an aging heat treatment at 175° C. for 15 hours, to obtain an aluminum alloy wire rod (diameter: 0.43 mm).

Comparative Example 22

A molten metal having an alloy composition shown in Table 2 was manufactured, and subjected to manufacturing condition M, to obtain an aluminum alloy wire rod (diameter: 0.08 mm).

(Comparative Example 23): Manufacturing Condition Q of Table 2

A molten metal having an alloy composition of Al-0.60% by mass Mg-0.30% by mass Si-0.50% by mass Fe-0.20% by mass Cu-0.02% by mass Ti was cast in a continuous casting machine, to produce a cast bar having a wire diameter of 25 mm. Next, the cast bar obtained was hot rolled, to produce an aluminum alloy wire having a wire diameter of 9.5 mm, and the wire was subjected to a solution treatment at 550° C. for 3 hours and cooled. The aluminum alloy wire was extended, washed, subjected to electrolytic degreasing, and polished by a stainless brush. An oxygen-free copper tape having a thickness of 0.4 mm and containing oxygen in an amount of 10 ppm was vertically attached and the oxygen-free copper tape was shaped on the aluminum alloy wire in a tubular manner so as to cover the aluminum alloy wire therewith, and thereafter a butted part of the oxygen-free copper tape was continuously welded in a TIG system. Thereafter, cold wire drawing working was performed with a wire drawing machine by use of a die at a working rate of 15 to 30%, to produce an aluminum alloy wire covered with copper, having a wire diameter of 0.2 mm.

[Evaluation]

The aluminum-based wire rods according to the Examples and the Comparative Examples were subjected to evaluation of characteristics described below. The evaluation conditions of each of the characteristics are as follows. The results are shown in Table 1.

[1] Alloy Composition

Measurement was performed by the emission spectrochemical analysis method according to JIS H1305: 2005. The measurement was performed using an emission spectrophotometer (manufactured by Hitachi High-Tech Science Corporation).

[2] Structure Observation

A metallographic structure was observed by TEM (Transmission Electron Microscopy) observation using a transmission electron microscope (JEM-2100PLUS manufactured by JEOL Co., Ltd.) at an acceleration voltage of 200 kV. An observation sample to be used was cut at a cross section parallel to the longitudinal direction (wire drawing direction X) of the wire rod by FIB (Focused Ion Beam) so as to have a thickness of 100 nm±20 nm, and finished by ion milling.

In the TEM observation, a boundary in which contrasts were discontinuously different was recognized as a crystal grain boundary with the difference between contrasts as the orientation of a crystal using gray contrast. No difference between gray contrasts was found in some cases even if crystal orientations were different depending on the diffraction condition of an electron beam. In such a case, while an angle between the electron beam and the sample was changed by inclining by ±3 degrees by two sample rotational axes orthogonal to each other in a sample stage of an electron microscope, the observed surface was photographed under a plurality of diffraction conditions, to recognize the grain boundary. The observed field of view was set to (15 to 40) μm×(15 to 40) μm, and a center and a position near the middle of a surface layer (position located towards the center from the surface layer by about ¼ of the wire diameter) on a line corresponding to a wire diameter direction (direction perpendicular to a longitudinal direction) in the cross section were observed. The observed field of view was appropriately adjusted according to the size of crystal grains.

Figure 9:
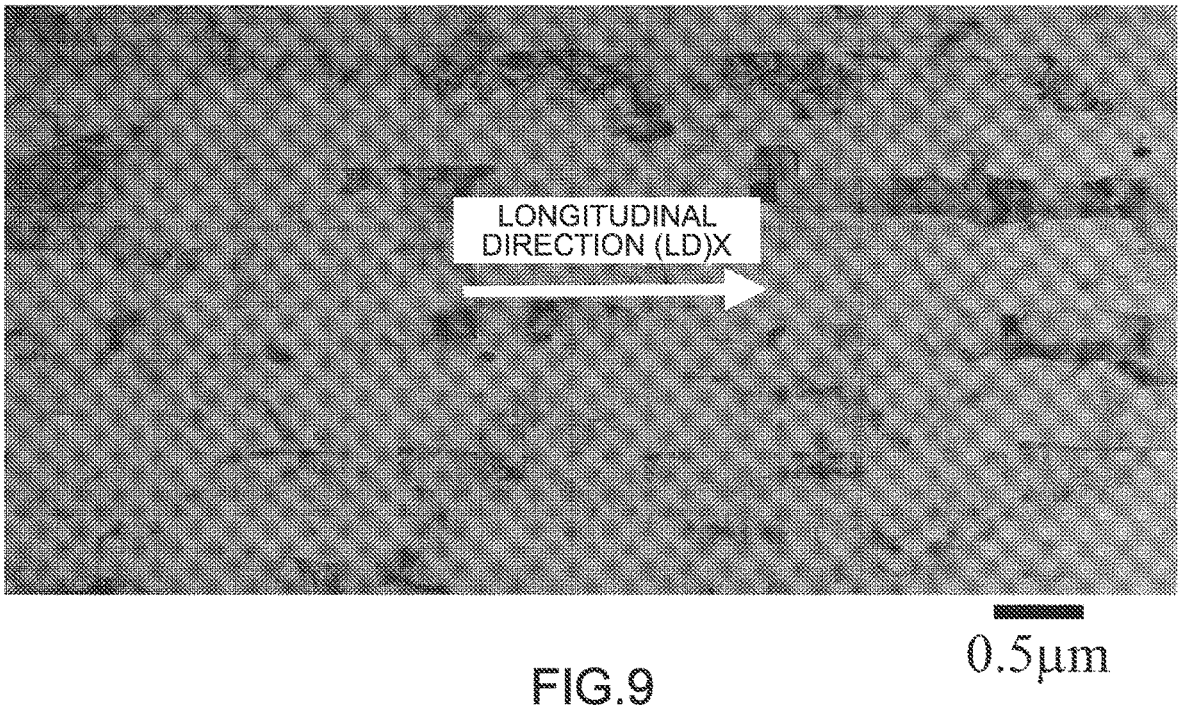
FIG. 9 is a TEM image illustrating the situation of a metallographic structure in a cross section parallel to a longitudinal direction X of an aluminum alloy wire rod according to Example 2.

The presence or absence of the fibriform metallographic structure was determined from an image photographed during the TEM observation, in the cross section parallel to the longitudinal direction (wire drawing direction X) of the wire rod. FIG. 9 illustrates a part of the TEM image of the cross section parallel to the longitudinal direction (wire drawing direction X) of the wire rod of Example 2, photographed during the TEM observation. In the present Example, the fibriform metallographic structure was estimated as "Presence" in a case in which the metallographic structure as illustrated in FIG. 9 was observed.

Furthermore, optional 100 crystal grains were selected in each observed field of view. The size perpendicular to the longitudinal direction of each of the crystal grains and the size parallel to the longitudinal direction of each of the crystal grains were measured, to calculate the aspect ratio of each of the crystal grains. Furthermore, the respective average values of the size perpendicular to the longitudinal direction of each of the crystal grains and the aspect ratio were calculated from the total of the observed crystal grains. In a case in which the observed crystal grains dearly had a size of larger than 400 nm, the number of the crystal grains selected for size measurement was reduced, and the average value was calculated. In a case in which the size parallel to the longitudinal direction of each of the crystal grains was clearly 10 or more times the size perpendicular to the longitudinal direction of each of the crystal grains, the crystal grains were determined to uniformly have an aspect ratio of 10 or more.

[3] X-Ray Diffraction Measurement

As illustrated in FIG. 4, a glass plate was lined with each wire rod, to provide a sample for X-ray measurement. The resultant was subjected to measurement according to a usual powder method, to acquire the data on the relationship between 2θ and the diffraction intensity in a diffraction condition. After the background was removed from the data of the X-ray diffraction pattern obtained, the integrated diffraction intensity of the diffraction peak due to the {100} plane and the integrated diffraction intensity of the diffraction peak due to the {110} plane were analyzed and defined as the peak intensity $I_{200}$ and the peak intensity $I_{220}$, respectively, to calculate the peak intensity ratio R ($I_{200}/I_{220}$).

[4] Tensile Strength

A tensile test was performed using a precision universal tester (manufactured by Shimadzu Corporation), to measure a tensile strength (MPa), according to JIS Z2241: 2001. The test was carried out under conditions of a distance between marks of 10 cm and a deformation speed of 10 mm/min.

Measurement of the tensile strength was performed for three wire rods (N=3) with respect to each wire rod in Table 1, and the average value was defined as the tensile strength of such each wire rod. A higher tensile strength was more preferable, and each wire rod in Table 1, having a tensile strength of 370 MPa or more, was defined as being at a pass level.

The tensile test was performed for three wire rods (N=3) with respect to each wire rod in Table 2, in terms of the wire rod manufactured in each of the manufacturing conditions and the wire rod heated at 110° C. for 24 hours after manufacturing, and the average values (N=3) thereof were defined as a tensile strength before heating, and a tensile strength after heating, of such each wire rod. With respect to each wire rod in Table 2, any wire rod before heating, having a tensile strength of 370 MPa or more, was defined as being at a pass level, any wire rod after heating, having a tensile strength of 370 MPa or more was defined as "very good", any wire rod after heating, having a tensile strength of less than 370 MPa and 340 MPa or more was defined as "good", and any wire rod after heating, having a tensile strength of less than 340 MPa was defined as "poor".

[5] Vickers Hardness (HV)

A Vickers hardness (HV) was measured using a microhardness tester HM-125 (manufactured by Akashi Corporation (current Mitutoyo Corporation)), according to JIS Z 2244: 2009. A test force was 0.1 kgf and a retention time was 15 seconds. Measurement positions were a center and a position near the middle of a surface layer (position located towards the center from the surface layer by about ¼ of the wire diameter) on a line corresponding to a wire diameter direction (direction perpendicular to a longitudinal direction) in the cross section parallel to the longitudinal direction of the wire rod, and the average value (N=5) of the measured values was defined as the Vickers hardness (HV) of the wire rod. In a case in which the difference between the maximum value and the minimum value of the measured values was 10 or more, the number of measurements was further increased, and the average value (N=10) was defined as the Vickers hardness (HV) of the wire rod. A higher Vickers hardness (HV) was more preferable, and a Vickers hardness (HV) of 100 or more was defined as being at a pass level, with respect to each wire rod in Tables 1 and 2.

[6] Bending Test

A W bending test was performed according to JIS Z 2248: 2006. The inner bending radius was set to 30 to 70% of the wire diameter. The test was performed for five wire rods (N=5) with respect to each wire rod. Evaluation was performed by observation of a bending top from above with an optical microscope. With respect to each wire rod in Tables 1 and 2, any wire rod in which no cracks were generated in all such five samples was defined as passing "good" and any wire rod in which cracks were generated in even one of such five samples was defined as not-passing "poor".

TABLE 1

| | | Alloy composition (% by mass) | | | | | Evaluation of structure | | | | Evaluation of characteristics | | |
|---|---|---|---|---|---|---|---|---|---|---|---|---|---|
| | | Mg | Si | Fe | Al and inevitable impurities | Manufacturing condition | Fibriform metallographic structure | Average value of size perpendicular to longitudinal direction of crystal grains | Aspect ratio | Peak intensity ratio R ($I_{200}/I_{220}$) | Tensile strength [MPa] | Vickers hardness (HV) | Bending test |
| Example | 1 | 0.75 | 0.69 | 0.32 | Balance | A | Presence | 350 nm | ≥10 | 0.76 | 390 | 103 | Good |
| | 2 | 0.75 | 0.69 | 0.32 | Balance | B | Presence | 240 nm | ≥10 | 0.61 | 460 | 118 | Good |
| | 3 | 0.75 | 0.69 | 0.32 | Balance | C | Presence | 180 nm | ≥10 | 0.47 | 560 | 150 | Good |
| | 4 | 0.75 | 0.69 | 0.32 | Balance | D | Presence | 130 nm | ≥10 | 0.34 | 650 | 167 | Good |
| | 5 | 0.75 | 0.69 | 0.32 | Balance | E | Presence | 370 nm | ≥10 | 0.78 | 400 | 105 | Good |
| | 6 | 0.75 | 0.69 | 0.32 | Balance | F | Presence | 200 nm | ≥10 | 0.33 | 570 | 152 | Good |
| | 7 | 0.24 | 1.95 | 0.11 | Balance | B | Presence | 260 nm | ≥10 | 0.77 | 450 | 121 | Good |
| | 8 | 0.22 | 0.22 | 0.15 | Balance | C | Presence | 220 nm | ≥10 | 0.32 | 490 | 132 | Good |
| | 9 | 0.81 | 0.75 | 1.42 | Balance | B | Presence | 170 nm | ≥10 | 0.55 | 550 | 147 | Good |
| | 10 | 0.91 | 0.88 | 0.15 | Balance | C | Presence | 140 nm | ≥10 | 0.34 | 610 | 162 | Good |
| | 11 | 1.76 | 0.31 | 0.11 | Balance | F | Presence | 210 nm | ≥10 | 0.36 | 520 | 138 | Good |
| | 12 | 1.76 | 1.85 | 0.11 | Balance | D | Presence | 80 nm | ≥10 | 0.32 | 690 | 215 | Good |
| Comparative Example | 1 | | — | | Balance | C | **Absence** | **800 nm** | 5 | **0.17** | **150** | **43** | **Poor** |
| | 2 | **0.17** | **0.17** | 0.21 | Balance | A | **Absence** | 340 nm | ≥10 | **0.19** | **310** | **82** | **Poor** |
| | 3 | 0.75 | 0.69 | 0.21 | Balance | G | Presence | **500 nm** | ≥10 | 0.28 | **320** | **91** | **Poor** |
| | 4 | 0.63 | 0.61 | 0.21 | Balance | H | Presence | 150 nm | ≥10 | 0.15 | 550 | 146 | Poor |
| | 5 | **1.82** | **2.11** | 0.21 | Balance | I | **Absence** | | | **Working cracks** | | | |
| | 6 | 0.91 | 0.88 | **1.62** | Balance | I | **Absence** | | | | | | |
| | 7 | 0.63 | 0.61 | 0.21 | Balance | J | **Absence** | | | | | | |
| | 8 | 0.70 | 0.70 | 0.03 | Balance | K | Presence | **500 nm** | ≥10 | 0.22 | 440 | 119 | **Poor** |
| | 9 | 0.51 | 0.58 | 0.79 | Balance | L | **Absence** | **5 μm** | 2 | 0.23 | **280** | **85** | Good |
| | 10 | 0.60 | 0.30 | 0.05 | Balance | M | **Absence** | **500 nm** | ≥10 | 0.21 | **260** | **75** | Good |

(Note)

Underlined bold characters in Table show wire rods outside the appropriate range of the present disclosure and wire rods of which evaluation results do not reach the pass level in the present Examples It was confirmed from the results in Table 1 that the aluminum alloy wire rod of each of Examples 1 to 12 of the present disclosure had a specific alloy composition and had a fibriform metallographic structure where crystal grains extended so as to be aligned in one direction, and had a size perpendicular to the longitudinal direction of the crystal grains, of 400 nm or less, in the cross section parallel to the one direction, and the main surface of such a wire rod had a crystal orientation distribution where the peak intensity ratio R ($I_{200}/I_{220}$) determined by an X-ray diffraction method satisfied 0.20 or more. FIG. 9 illustrates a TEM image of the cross section parallel to the wire drawing direction of the aluminum alloy wire rod according to Example 2. The aluminum alloy wire rod of each of Examples 1 and 3 to 12 was also confirmed to have the same metallographic structure in the cross section parallel to the longitudinal direction, as the structure illustrated in FIG. 9.

It was confirmed that the aluminum alloy wire rod of each of Examples 1 to 12, not only having such a specific metallographic structure, but also having a specific texture on the main surface, could simultaneously satisfy a high strength (for example, a tensile strength of 370 MPa or more and a Vickers hardness (HV) of 100 or more) comparable to that of an iron-based or copper-based metal material, and excellent bending workability (for example, the aluminum alloy material, which was in the form of a wire rod, did not cause any cracking, when having an inner bending radius corresponding to 30 to 70% of the wire diameter in the W bending test performed according to JIS Z 2248: 2006).

On the other hand, it was confirmed that the aluminum-based wire rod of each of Comparative Examples 1 to 4 and 8 to 10 fell under any one or more of the following: the composition did not satisfy the appropriate range of the alloy composition of the present disclosure, the aluminum-based wire rod did not have any fibriform metallographic structure where crystal grains extended so as to be aligned in one direction, the wire rod did not have a size perpendicular to the longitudinal direction of the crystal grains, of 500 nm or more, and the peak intensity ratio R ($I_{200}/I_{220}$) on the main surface of the wire rod was less than 0.20. It was confirmed that the aluminum-based wire rod of each of Comparative Examples 1 to 4 and 8 to 10 was remarkably inferior in one or more characteristics of tensile strength, Vickers hardness (HV) and bending workability as compared with the aluminum alloy wire rod of each of Examples 1 to 12.

It was also confirmed that the alloy composition of the bar prepared did not satisfy the appropriate range of the present disclosure and thus working cracks were caused while wire drawing working [1] was performed one to three times in predetermined conditions, in each of Comparative Examples 5 and 6. It was also confirmed that aging precipitation heat treatment [0] was performed before wire drawing working [1] and thus working cracks were caused while wire drawing working [1] was performed twice in predetermined conditions, in Comparative Example 7.

TABLE 2

| | | Alloy composition (% by mass) | | | | | | | | | Evaluation of structure | | | | Evaluation of characteristics | | | |
|---|---|---|---|---|---|---|---|---|---|---|---|---|---|---|---|---|---|---|
| | | | | | At least one selected from Cu, Ag, Zn, Ni, B, Ti, Co, Au, Mn, Cr, V, Zr and Sn | | | | | | | Average value of size perpendicular to longitudinal direction of crystal grains | | | Tensile strength (TS) | | | |
| | | Mg | Si | Fe | 1 | 2 | | total | Al and inevitable impurities | Manufacturing condition | Fibriform metallographic structure | | Aspect ratio | Peak intensity ratio R ($I_{200}/I_{220}$) | Before heating [MPa] | After heating — | Vickers hardness (HV) | Bending test |
| Example | 13 | 0.73 | 0.71 | 0.28 | Cu 0.12 | — | | 0.12 | Balance | A | Presence | 340 nm | ≥10 | 0.72 | 390 | Good | 103 | Good |
| | 14 | 0.73 | 0.71 | 0.28 | Cu 0.33 | Zr 0.06 | | 0.39 | Balance | B | Presence | 240 nm | ≥10 | 0.55 | 470 | Very good | 127 | Good |
| | 15 | 0.73 | 0.71 | 0.28 | Cu 1.21 | Ag 0.71 | | 1.92 | Balance | C | Presence | 150 nm | ≥10 | 0.36 | 580 | Very good | 161 | Good |
| | 16 | 0.73 | 0.71 | 0.28 | Cu 0.71 | Ni 0.32 | | 1.03 | Balance | D | Presence | 90 nm | ≥10 | 0.32 | 670 | Very good | 186 | Good |
| | 17 | 0.73 | 0.71 | 0.28 | Mn 0.12 | — | | 0.12 | Balance | E | Presence | 370 nm | ≥10 | 0.77 | 380 | Very good | 106 | Good |
| | 18 | 0.73 | 0.71 | 0.28 | Cr 0.22 | Sn 0.05 | | 0.27 | Balance | F | Presence | 220 nm | ≥10 | 0.35 | 550 | Very good | 152 | Good |
| | 19 | 0.73 | 0.71 | 0.28 | Zr 0.13 | Cr 0.08 | | 0.21 | Balance | A | Presence | 350 nm | ≥10 | 0.68 | 380 | Very good | 103 | Good |
| | 20 | 0.73 | 0.71 | 0.28 | Zn 0.11 | Au 0.06 | | 0.17 | Balance | B | Presence | 220 nm | ≥10 | 0.51 | 490 | Very good | 136 | Good |
| | 21 | 0.73 | 0.71 | 0.28 | Cr 0.11 | Mn 0.11 | | 0.22 | Balance | C | Presence | 140 nm | ≥10 | 0.34 | 560 | Very good | 152 | Good |
| | 22 | 0.24 | 1.95 | 0.11 | Co 0.13 | V 0.15 | | 0.28 | Balance | E | Presence | 330 nm | ≥10 | 0.72 | 400 | Good | 112 | Good |
| | 23 | 0.22 | 0.22 | 0.15 | Cu 0.53 | Cr 0.07 | | 0.60 | Balance | F | Presence | 240 nm | ≥10 | 0.35 | 480 | Very good | 133 | Good |
| | 24 | 0.73 | 0.71 | 1.42 | Cu 1.22 | Mn 0.22 | | 1.44 | Balance | B | Presence | 210 nm | ≥10 | 0.75 | 420 | Very good | 116 | Good |
| | 25 | 0.91 | 0.88 | 0.15 | Cu 0.07 | — | | 0.07 | Balance | C | Presence | 130 nm | ≥10 | 0.36 | 600 | Very good | 165 | Good |
| | 26 | 0.98 | 0.60 | 0.07 | Cu 0.28 | Cr 0.14 | | 0.42 | Balance | E | Presence | 320 nm | ≥10 | 0.72 | 400 | Very good | 110 | Good |
| | 27 | 1.76 | 0.31 | 0.11 | Mn 0.33 | Cr 0.22 | | 0.55 | Balance | B | Presence | 160 nm | ≥10 | 0.45 | 510 | Very good | 142 | Good |
| | 28 | 1.76 | 1.82 | 0.28 | Cu 1.22 | Cr 0.14 | | 1.36 | Balance | D | Presence | 70 nm | ≥10 | 0.33 | 690 | Very good | 203 | Good |
| Comparative Example | 11 | | | | — | | | | Balance | C | **Absence** | **800 nm** | 5 | **0.17** | **150** | **Poor** | **43** | **Poor** |
| | 12 | **0.17** | **0.17** | 0.21 | Cu 0.12 | — | | 0.12 | Balance | A | Presence | 330 nm | ≥10 | 0.21 | **320** | **Poor** | **89** | **Poor** |
| | 13 | 0.73 | 0.71 | 0.28 | Cu 0.12 | — | | 0.12 | Balance | G | Presence | **500 nm** | ≥10 | 0.25 | **310** | **Poor** | **86** | **Poor** |
| | 14 | 0.73 | 0.71 | 0.28 | Cu 0.12 | — | | 0.12 | Balance | H | Presence | 140 nm | ≥10 | 0.18 | 560 | Very good | 152 | **Poor** |
| | 15 | **1.82** | **2.11** | 0.21 | Cu 0.12 | — | | 0.12 | Balance | I | **Absence** | | | **Working cracks** | | | | |
| | 16 | 0.91 | 0.88 | **1.62** | Cu 0.12 | — | | 0.12 | Balance | I | **Absence** | | | | | | | |
| | 17 | 0.73 | 0.71 | 0.28 | Cu 1.81 | Zr 0.28 | | **2.09** | Balance | I | **Absence** | | | | | | | |
| | 18 | 0.73 | 0.71 | 0.28 | Cu 0.12 | — | | 0.12 | Balance | J | **Absence** | | | | | | | |
| | 19 | 1.03 | 0.90 | 0.20 | Cu 0.16 | Cr 0.15 | | 0.31 | Balance | N | **Absence** | **500 nm** | ≥10 | 0.27 | 440 | Good | 122 | **Poor** |
| | 20 | 0.90 | 0.80 | 0.20 | Cu 1.30 | — | | 1.30 | Balance | O | **Absence** | **500 nm** | ≥10 | 0.25 | 470 | Good | 130 | **Poor** |
| | 21 | 0.70 | 0.69 | 1.01 | Cu 0.35 | — | | 0.35 | Balance | P | **Absence** | **4 μm** | 2 | 0.24 | **320** | **Poor** | **88** | **Poor** |
| | 22 | 0.60 | 0.30 | 0.05 | | — | | | Balance | M | **Absence** | **500 nm** | ≥10 | 0.22 | **260** | **Poor** | **75** | Good |
| | 23 | 0.60 | 0.30 | 0.50 | Cu 0.20 | Ti 0.02 | | 0.22 | Balance | Q | Presence | 300 nm | ≥10 | **0.17** | 550 | Good | 160 | **Poor** |

Figure 10:
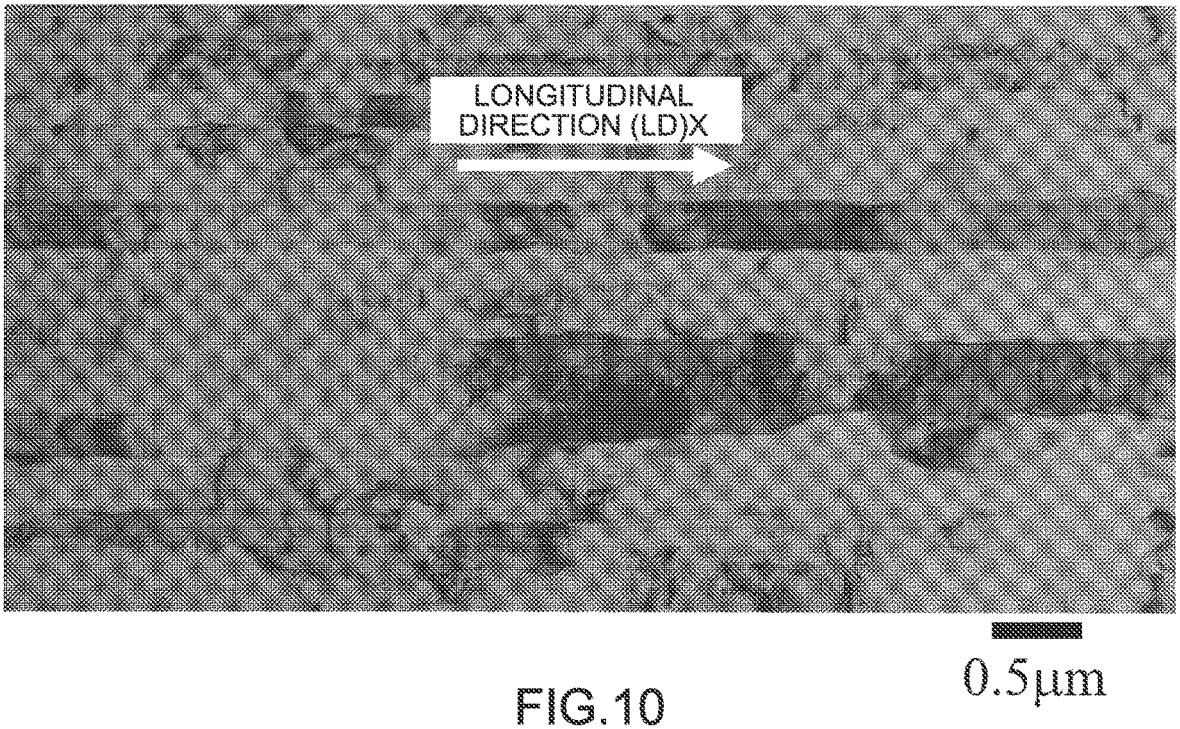
FIG. 10 is a TEM image illustrating the situation of a metallographic structure in a cross section parallel to a longitudinal direction X of an aluminum alloy wire rod according to Example 14.

(Note)
Underlined bold characters in Table show wire rods outside the appropriate range of the present disclosure and wire rods of which evaluation results do not reach the pass level in the present Examples It was confirmed from the results in Table 2 that the aluminum alloy wire rod of each of Examples 13 to 28 of the present disclosure had a specific alloy composition and had a fibriform metallographic structure where crystal grains extended so as to be aligned in one direction, and had a size perpendicular to the longitudinal direction of the crystal grains, of 400 nm or less, in the cross section parallel to the one direction, and the main surface of such a wire rod had a crystal orientation distribution where the peak intensity ratio R ($I_{200}/I_{220}$) determined by an X-ray diffraction method satisfied 0.20 or more. FIG. 10 illustrates a TEM image of the cross section parallel to the wire drawing direction of the aluminum alloy wire rod according to Example 14. The aluminum alloy wire rod of each of Examples 13 and 15 to 28 was also confirmed to have the same metallographic structure in the cross section parallel to the longitudinal direction, as the structure illustrated in FIG. 10.

It was confirmed that the aluminum alloy wire rod of each of Examples 13 to 28, not only having such a specific metallographic structure, but also having a specific texture on the main surface, could simultaneously satisfy high strength (for example, a tensile strength of 370 MPa or more and a Vickers hardness (HV) of 100 or more) comparable to that of an iron-based or copper-based metal material and excellent bending workability (for example, the aluminum alloy material, which was in the form of a wire rod, did not cause any cracking, when having an inner bending radius corresponding to 30 to 70% of the wire diameter in the W bending test performed according to JIS Z 2248: 2006). It was also confirmed that the aluminum alloy wire rod of each of Examples 13 to 28 of the present disclosure contained at least one selected from Cu, Ag, Zn, Ni, B, Ti, Co, Au, Mn, Cr, V, Zr and Sn in a predetermined amount and thus had a high tensile strength maintained even after heating and excellent heat resistance.

On the other hand, it was confirmed that the aluminum-based wire rod of each of Comparative Examples 11 to 14 and 19 to 23 fell under any one or more of the following: the composition did not satisfy the appropriate range of the alloy composition of the present disclosure, the aluminum-based wire rod did not have any fibriform metallographic structure where crystal grains extended so as to be aligned in one direction, the wire rod did not have a size perpendicular to the longitudinal direction of the crystal grains, of 500 nm or more, and the peak intensity ratio R ($I_{200}/I_{220}$) on the main surface of the wire rod was less than 0.20. It was confirmed that the aluminum-based wire rod of each of Comparative Examples 11 to 14 and 19 to 23 was remarkably inferior in one or more characteristics of the tensile strength in the state of wire drawing working (before heating), the tensile strength (heat resistance) after heating, Vickers hardness (HV) and bending workability as compared with the aluminum alloy wire rod of each of Examples 13 to 28.

It was also confirmed that the alloy composition of the bar prepared did not satisfy the appropriate range of the present disclosure and thus working cracks were caused while cold working [1] was performed one to three times in predetermined conditions, in each of Comparative Examples 15 to 17. It was also confirmed that aging precipitation heat treatment [0] was performed before cold working [1] and thus working cracks were caused while wire drawing working [1] was performed twice, in Comparative Example 18.

What is claimed is:

1. An aluminum alloy material having an alloy composition comprising 0.2 to 1.8% by mass of Mg, 0.2 to 2.0% by mass of Si, 0.01 to 1.50% by mass of Fe, 0 to 2.0% by mass in total of at least one selected from Cu, Ag, Zn, Ni, B, Ti, Co, Au, Mn, Cr, V, Zr and Sn, with the balance containing Al and inevitable impurities, wherein the aluminum alloy material has a fibriform metallographic structure where crystal grains extend so as to be aligned in one direction;

an average value of a size perpendicular to a longitudinal direction of the crystal grains is 400 nm or less in a cross section parallel to the one direction; and the aluminum alloy material has a main surface having a crystal orientation distribution which satisfies a peak intensity ratio R ($I_{200}/I_{220}$) of a peak intensity $I_{200}$ of a diffraction peak due to a {100} plane to a peak intensity $I_{220}$ of a diffraction peak due to a {110} plane, of 0.20 or more, determined by an X-ray diffraction method.

2. The aluminum alloy material according to claim 1, comprising 0% by mass of at least one selected from Cu, Ag, Zn, Ni, B, Ti, Co, Au, Mn, Cr, V, Zr and Sn.

3. The aluminum alloy material according to claim 1, comprising 0.06 to 2.0% by mass in total of at least one selected from Cu, Ag, Zn, Ni, B, Ti, Co, Au, Mn, Cr, V, Zr and Sn.

4. The aluminum alloy material according to claim 1, wherein the aluminum alloy material has a Vickers hardness (HV) of 100 to 250.

5. The aluminum alloy material according to claim 2, wherein the aluminum alloy material has a Vickers hardness (HV) of 100 to 250.

6. The aluminum alloy material according to claim 3, wherein the aluminum alloy material has a Vickers hardness (HV) of 100 to 250.

7. The aluminum alloy material according to claim 1, wherein the aluminum alloy material is covered with at least one metal selected from the group consisting of Cu, Ni, Ag, Sn, Au and Pd.

8. A conductive member comprising the aluminum alloy material according to claim 1.

9. The conductive member according to claim 8, wherein the conductive member is an elevator cable.

10. The conductive member according to claim 8, wherein the conductive member is an airplane electric wire.

11. A battery member comprising the aluminum alloy material according to claim 1.

12. A fastening component comprising the aluminum alloy material according to claim 1.

13. A spring component comprising the aluminum alloy material according to claim 1.

14. A structural component comprising the aluminum alloy material according to claim 1.

* * * * *